US008750542B2

(12) United States Patent
Thompson

(10) Patent No.: US 8,750,542 B2
(45) Date of Patent: Jun. 10, 2014

(54) SPEAKER CONFIGURATION

(75) Inventor: Ambrose C. T. Thompson, Aylesbury (GB)

(73) Assignee: Martin Audio Limted, Buckinghamshire (GB)

( * ) Notice: Subject to any disclaimer, the term of this patent is extended or adjusted under 35 U.S.C. 154(b) by 1226 days.

(21) Appl. No.: 12/445,931

(22) PCT Filed: Oct. 16, 2007

(86) PCT No.: PCT/GB2007/003918

§ 371 (c)(1),
(2), (4) Date: Jun. 7, 2010

(87) PCT Pub. No.: WO2008/047089

PCT Pub. Date: Apr. 24, 2008

(65) Prior Publication Data

US 2010/0246839 A1 Sep. 30, 2010

(30) Foreign Application Priority Data

Oct. 16, 2006 (GB) ..... 0620488.7

(51) Int. Cl.
*H04R 5/02* (2006.01)

(52) U.S. Cl.
USPC ..... 381/303; 381/56; 381/59; 381/336; 381/387

(58) Field of Classification Search
USPC ..... 381/1, 2, 5, 17, 18, 19, 20, 22, 300, 381/301, 302, 303, 304, 305, 306, 307, 308, 381/26, 61, 80, 81, 85, 86, 87, 89, 332, 333, 381/335, 336, 91, 92, 97, 98, 101, 102, 103, 381/107, 119, 120, 122, 56, 59, 385, 386, 381/387, 389
See application file for complete search history.

(56) References Cited

U.S. PATENT DOCUMENTS

2005/0031135 A1 2/2005 Devantier et al.
2007/0110268 A1 * 5/2007 Konagai et al. ..... 381/335

FOREIGN PATENT DOCUMENTS

EP 1523221 4/2005
GB 2259426 3/1993
GB 2442983 A 4/2008
WO WO-2008047089 A2 4/2008

OTHER PUBLICATIONS

"DisplayTM Revealed", The Edge magazine, Issue 11, by Martin Audio Limited, p. 6-7, Apr. 2005.*
"How ViewPoint Will Help W8L Users", The Edge magazine, Issue 6, by Martin Audio Limited, p. 5, Sep. 2002.*
International Search Report, PCT Application No. PCT/GB2007/003918, published Apr. 24, 2008 (21 pages).
Search Report for GB0620488.7, dated Feb. 12, 2007 (3 pages).

(Continued)

*Primary Examiner* — Leshui Zhang
(74) *Attorney, Agent, or Firm* — Gardere Wynne Sewell LLP

(57) ABSTRACT

A method of configuring an array of speaker elements is disclosed. The method computes a sound that pressure level at various points in the venue and is evaluated by various objective functions. The configuration of a candidate array is changed, for example by the orientation or position of the speakers and the sound field is recalculated. The process is then iterated until an acceptable configuration is found. The real physical array of speakers is then configured in that manner. The method also provides a 3D plot of the sound pressure level displayed against frequency and position in the venue.

29 Claims, 19 Drawing Sheets

(56) References Cited

OTHER PUBLICATIONS

"Display Revealed," The Edge, [Online] No. 11, Apr. 2005 (Apr. 2004), XP002491336, retrieved on Jul. 30, 2008 from http://www.martin-audio.com/edge/THE_EDGE11/p6.html (2 pages).
"Introducing Wavefront Line Array EASE DLL's," Ambrose Thompson, [Online] Nov. 15, 2004, XP002491337, retrieved from http://www.martin-audio.com/softtech/Introducing_Martin_Audio_DLLs.pdf (4 pages).
"MAPP Online Pro Release Notes [Online] 2005," XP002491338, retrieved from http://www.meyersound.com/products/mapponline/pro/releasenotes.htm on Jul. 28, 2008 (6 pages).
"MAPP Online Accuracy Confirmed by Test of Predicted Response," Meyer Sound Technical Report, [Online], retrieved from http://web.archive.org.web/20060913172928/http://www.meyersound.com/support/papers/meyer mapp accuracy.pdf; purportedly archived on Sep. 13, 2006 (4 pages).
"Experiences with Line Arrays," Mark Bailey, JBL Professional, AES 18th Conference, 2003, XP002491340, (9 pages).
"Direct Search Solution of Numerical and Statistical Problems," Robert Hooke and T.A. Jeeves, Westinghouse Research Laboratories, Pittsburgh, PA, Journal of ACM, vol. 8, 1961, XP002491341 (18 pages).
"Meyer Sound MAPP Online Pro Release Notes," http://web.archive.org.web/20060819084617/http://www.meyersound.com/products/mapponline/pro/releasenotes.htm; purportedly published Aug. 19, 2006 (5 pages).
"Advances in Line Array Technology for Live Sound," Bill Webb and Jason Baird, Nov. 2003 (9 pages).
"Simulation of the acoustic field produced by cavities using the Boundary Element—Rayleigh Integral Method (BERIM) and its application to a horn loudspeaker," Stephen Kirkup and Ambrose Thompson, Jul. 2004 (8 pages).
"Line Array Performance at Mid and High Frequencies," Henrik Staffeldt and Ambrose Thompson, Convention Paper 6274, presented at the 117th Convention of the Audio Engineering Society, San Franciso, CA, Oct. 28-31, 2004 (11 pages).
Start, E.W., et al. "Analysis of DDS-Controlled Loudspeaker Arrays by Near Field Acoustic Holography," Proceedings—Institute of Acoustics, 2001; 23: 95-110; (15 pages).
Van Beuningen, G.W.J., et al. "Optimizing Directivity Properties of DSP Controlled Loudspeaker Arrays," Proceedings—Institute of Acoustics, 2000; 22:17-38; (22 pages).
Start, Evert, et al. "Optimisation of DDS-Controlled Loudspeaker Arrays Using a Hybrid PSM-BEM Model," Proceedings—Institute of Acoustics, CD-ROM Edition, 2005; 27 (12 pages).
HK Audio Concert Sound, Cohedra Manual 2.0, Aug. 2004 (4 pages).

* cited by examiner

SPEAKER CONFIGURATION

The present invention relates to the configuration of arrays of speakers.

BACKGROUND

Vertically arrayed loudspeakers systems, or "line arrays", are currently the predominant form of system used in large and medium scale touring sound systems. A typical line array is shown in FIG. 1. The line array 1 comprises several loudspeaker elements 2 arranged vertically by being suspended from the ceiling of a venue on suspension chains 3. As shown in FIG. 2, the splay angle $x_i$ between neighbouring elements is adjusted by means of an adjustment bar 4 which allows different settings for the spacing between the back of the elements, while the distance between the front of the elements remains fixed.

Due to the complex nature of the interactions of the elemental loudspeakers a wealth of CAD tools is available that predict the output of a given array or combination. Such tools include EASE, form ADA (www.ada-library.de), CATT, from CATT-Acoustic (http://www.catt.se/), and DISPLAY, from Martin Audio (www.martin-audio.com.). These kind of systems have been available for at least 10 years.

To design an array with these tools the user manually alters the splay angles between one element speaker and the next in the array and inspects the output; this process is repeated until an acceptable output is achieved.

Some of the factors important to the success of the manual method of array design are:

1. Accuracy of the radiation model used to predict the output of the array.
2. The user's mental model of how the complete sound system works.
3. Speed of feedback to the user of the CAD system's prediction.
4. Size and granularity of the domain used.
5. Time available for the user to find a solution using the CAD system.

The present invention aims to improve upon this method of configuring speaker arrays for use so that they provide the desired sound field.

The simple radiation model that forms the basis for practically all array CAD tools has been termed the directional point source model. Pressure at the receiver points r is formed from the complex summation of pressure from all elemental sources. Each elemental source has an associated measured complex 'balloon' of pressure at a set of frequencies f and an orientation. The computation defines a ray from each source to each receiver point, for each frequency the pressure where the ray intersects the balloon is determined via a complex interpolation of nearby measured points, and this pressure is then propagated to the receiver points to provide a pressure amplitude P(r,f) (H. Staffeldt. Prediction of sound pressure fields of loudspeaker arrays from loudspeaker polar data with limited angular and frequency resolution—108th Convention of the Audio Engineering Society, Preprint : 5130, 2000). It is assumed that the measured data for each source, which is used to determine the 'balloon', is obtained in the far-field for that source and that the presence of neighbouring enclosures is not significant, since neighbouring enclosures are seldom present when source measurements are performed. Despite the latter assumption the simple model is thought to give a good indication of the expected pressure at the receiver points.

Many users of CAD systems tasked with manual design of vertical arrays only evaluate the performance on a thin strip of the venue normal to the front of the array. This method allows relatively rapid feedback when compared to full audience plane calculations and it is found that good performance on the strip generally reflects in good performance in the full calculation assuming each element has consistent horizontal directionality. The examples of the invention given below follow this convention but the invention also allows for the incorporation of points outside the strip whilst still avoiding a full calculation.

The normal presentation of performance along the strip to the user either employs overlaid frequency responses at different receiver points or overlaid plots of pressure at the receiver points for different frequencies (distance plots). Both of these views become cumbersome when more than 10 graphs are overlaid and unworkable when frequency and receiver points are of the order of 100 or more. What is required is to be able to view the pressure at all receiver points and at all frequencies at once. This can be achieved with a 3D plot where the x axis represents frequency, the y axis receiver position index and the z axis pressure. Conceptually it is like stacking up all the frequency response plots along the y axis or indeed all the distance plots along the x axis. In this manner the result of any change is seen across the entire range of frequency and position. Such 3D plots are shown in the Figures, discussed below, for the performance of the speaker arrays of the invention.

EP 1 523 221 A2 discloses a system for setting up a domestic hi-fi system, in particular the sub woofers thereof. A sub woofer is placed in possible positions and the transfer function of the system is measured by sampling a test sound with a microphone at one or plural listening positions. The number of available transfer functions is increased by modifying the measured ones with ones for adding delay to the sound signal before it is reproduced by the sub woofer etc. Set-ups having more than one subwoofer are made by superposing the transfer functions. The system does not therefore model the propagation of the sound in the space but merely measures the output (i.e. the sound at the listening position) empirically. The system searches through the possible systems and ranks them by various aspects of their transfer function, allowing one to be chosen.

GB 2 259 426 A discloses another audio system whose performance is empirically measured. An array of speakers is used to produce constant directivity over a wide range of frequencies. The directivity functions between each speaker of the array and each of a number of positions equidistant from the array are measured and then compensating filter functions are calculated, which filter functions are used by digital filters respective to the speakers that modify the otherwise common sound signal before it is applied to the individual speakers.

SUMMARY OF INVENTION

The present invention provides methods of configuring loudspeaker arrays, configured speaker arrays and computer program products for configuring speaker arrays, as well as 3D sound pressure plot devices, as defined in the appended claims.

BRIEF DESCRIPTION OF THE DRAWINGS

Examples of the invention will now be described with reference to the accompanying drawings, of which.

DESCRIPTION OF THE EXAMPLES

Figure 1:
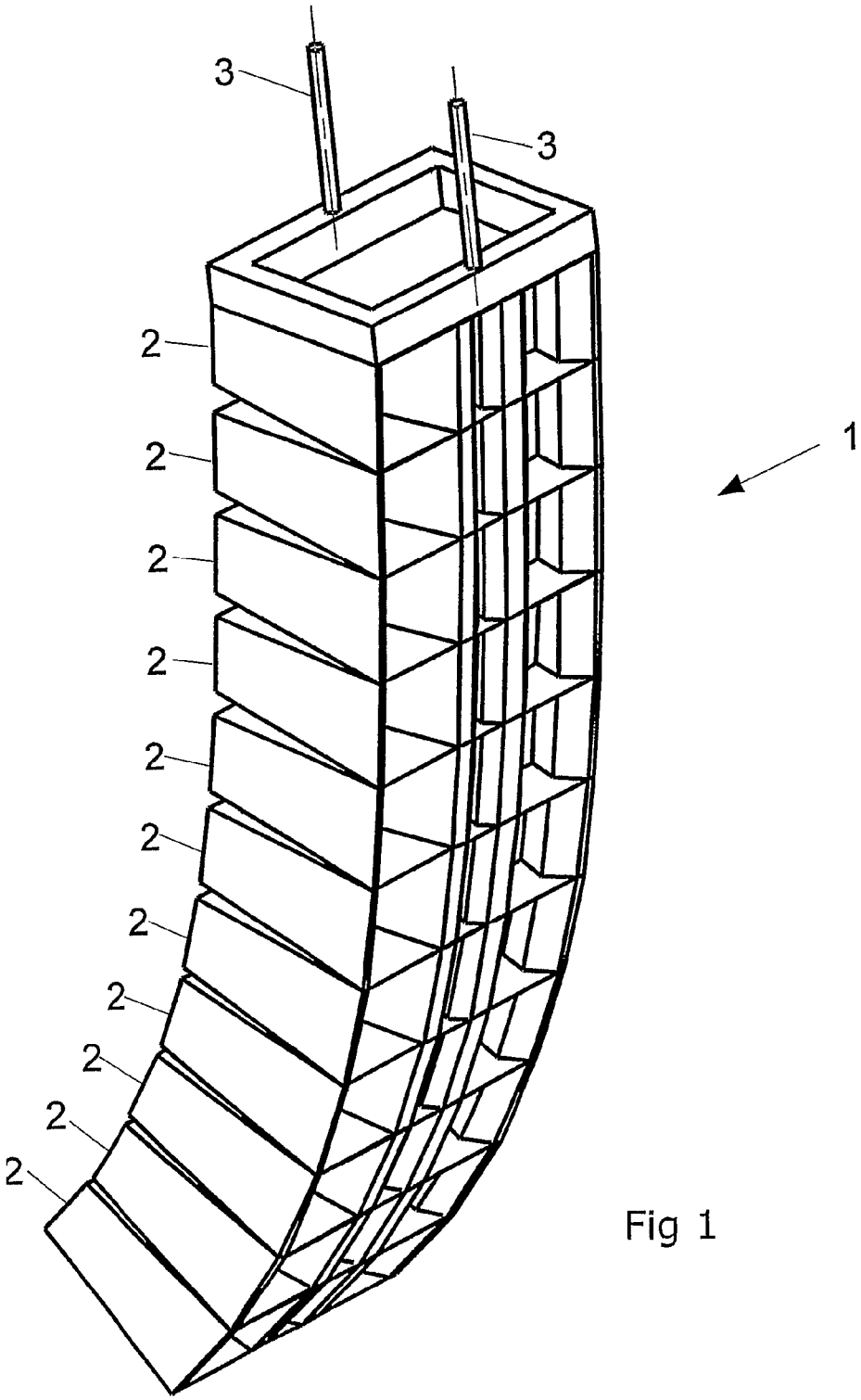
Fig 1 PRIOR ART
FIG. 1 is a perspective view of a typical line array loudspeaker system.
Figure 2:
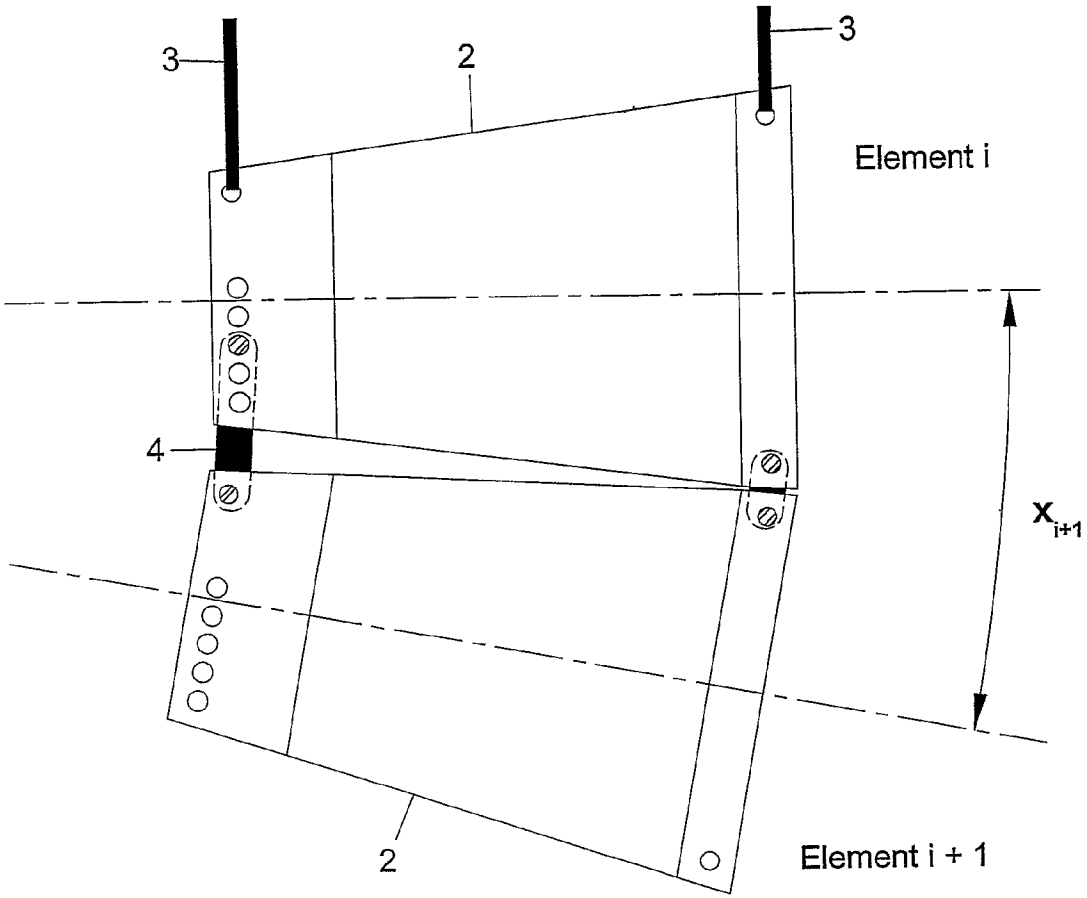
Fig 2 PRIOR ART
FIG. 2 is a side view of the mechanical mechanism for adjusting the splay angle between two line array elements.

In the present invention a computer system is used to optimise the configuration of a speaker array.

Optimisation is a branch of mathematics which encompasses techniques that attempt to find the N parameters $x \in \mathbb{R}^N$ that minimise an objective function $\epsilon(x)$, optionally including constraints on the parameters. A simple classification between the techniques is whether the calculation method uses the gradient of the objective function in order to determine the direction of the search in parameter space. One such class of calculation method which does not is the 'generalised pattern search' described in an introductory manner in J. E. Dennis J. Virginia, Derivative-free pattern search methods for multidisciplinary problems, American Institute of Aeronautics and Astronautics, pages 922-932, 1994 and analysed further in C. Audet and J. Dennis. Analysis of generalized pattern searches, TR00-07 Department of Computational & Applied Mathematics, Rice University, Houston Method 1 pattern search be viewed as an adaptive grid search over the search space where the grid or mesh M is defined by the mesh size, $\Delta \in \mathbb{R}_+$ and a set directions $D \subset \mathbb{R}^N$ whose positive linear combinations span $\mathbb{R}^N$. Candidates for evaluation of the objective function are determined by polling neighbouring points, after an initial optional search of the mesh using some other means. A typical sequence of steps taken by a pattern search method is shown in Method 1 below, which describes the method in structured English.

TABLE 1

Method 1 pattern search

```
Require: x_k , Δ_k for k = 1
1:   while Stopping criteria not met do
2:       SEARCH : Perform a global search from the search
         point anywhere on M_k either heuristically or with
         some knowledge of the model to decide candidates for
         evaluation
3:       if improved mesh point found (ε(x_{k+1}) < ε(x_k)) then
```

TABLE 1-continued

Method 1 pattern search

```
4:           Optionally increase the mesh size (Δ_{k+1} ≥ Δ_k)
5:           search point becomes this improved point
6:           break
7:       else
8:           POLL : look at neighbouring points in the mesh
9:           if improved mesh point found (ε(x_{k+1}) < ε(x_k)) then
10:              search point becomes this improved point
11:              break
12:          else
13:              Reduce mesh size (Δ_{k+1} < Δ_k) {This point is a mesh
                 local optimiser}
14:              search point becomes this point
15:              break
16:          end if
17:      end if
18:      increment k
19:  end while
```

The method homes in on an optimal point by checking the neighbouring points of the current point to see if they are better and if not reducing the size of the mesh so that closer points can be found. The optional step of increasing the mesh size (step 4) is to help find other minima in the search space. The iterations can be stopped according to various criteria, for example, time or number of iterations, mesh size, relative change in the objective function or an absolute value of the objective function can all be used for the stopping criteria.

In a first example of the present invention Method 1 is used to optimise the splay angles of a line array. (Other optimisation calculation methods may be used, however, whether they use the gradient of the objective function or otherwise.) Taking a particular vertical array of N identical uniformly excited elemental loudspeakers as an example these are characterised by a set of splay angles x, each being the angle between one element and the next. The line array is modelled as being, as a whole, at a fixed position in a venue, which in turn is defined by a set of audience $r_a$ and non-audience planes $r_{na}$.

The resultant complex sound pressure produced by the speaker array at the audience points is a matrix P having elements $[P]_{i,j}=P(r_a,f,x)$ where x is the set of the splay angles (a parameter) and f is a set of discrete frequencies $f_j$ and $r_a$ is a set of audience positions $r_i$. The positions are numbered with a position index i from 1 at the position nearest the speaker array increasing with distance to a maximum furthest from the speaker array. At each iteration κ this matrix is calculated and then an objective function based $\epsilon(P)$ on it is evaluated to see if a better configuration for the array has been found. The pressure function is evaluated at a set of discrete location points in the venue and for a discrete set of frequencies. This discretisation of the independent variables sets the level of fine detail that can be resolved.

The spatial variable is defined at intervals in the region of 0.1 m to 1.0 m. Frequency is divided into 1/36th octave bands and is adequate for representing most frequency responses. The pressure function P is evaluated using a computer by using the directional point source model, as, of course, is done in the known CAD systems.

Figure 3:
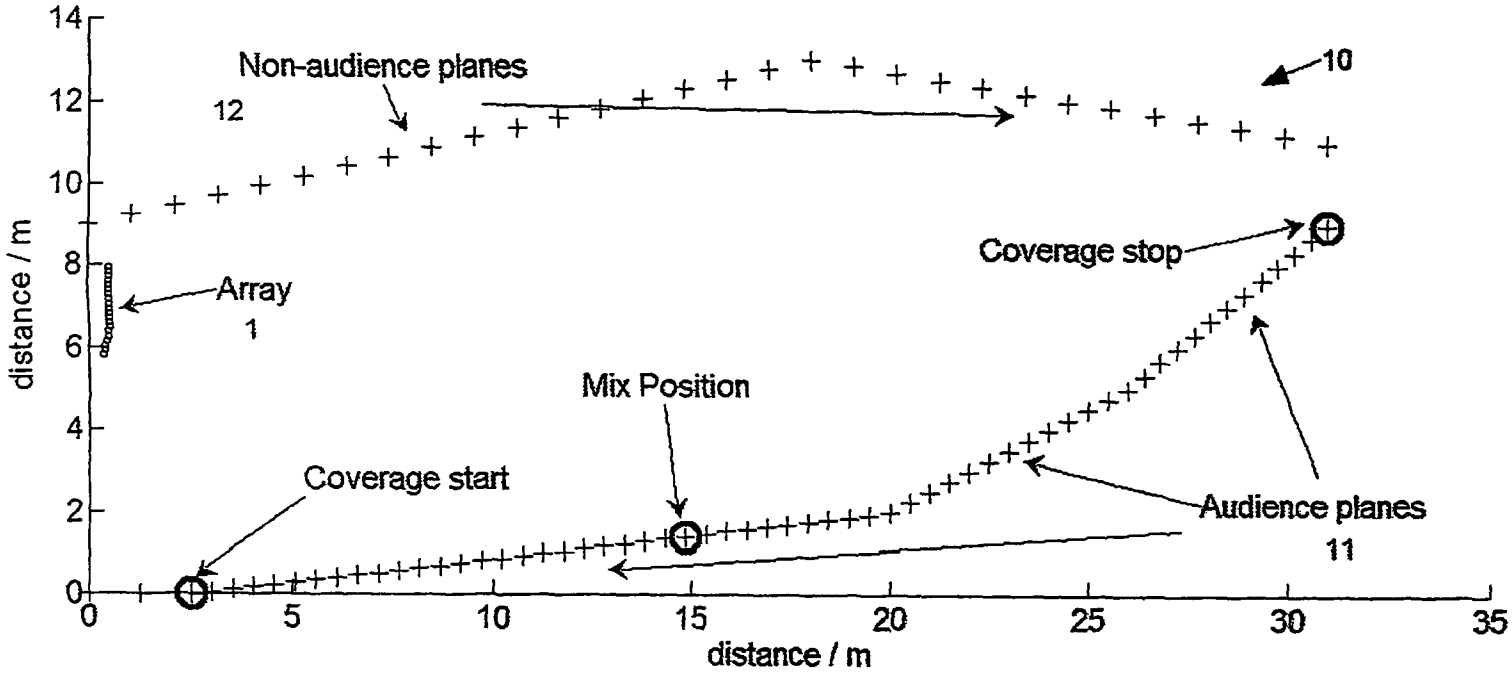
FIG. 3 is a cross section through a venue showing the points at which the pressure produced by the array of speakers is evaluated.

FIG. 3 shows the set of points used in this example. FIG. 3 shows cross section through a venue 10 with the line array 1 suspended at one end. A set of location points 11 is shown which are typical of where the audience would be on banked seating. Since this is a vertical 2D slice through the venue (in particular through the array elements and on the axis thereof) and since that is being taken as representative of the whole venue the points are termed "audience planes". Non-audience points or "planes" are defined at the ceiling of the venue or unused audience planes.

The optimisation method used expects an objective function that returns a single real positive number because that is simple to compare with the previous value to determine which is better. Below are given various examples for the objective function used. These objective functions would be suitable for use with the many other optimisation methods that exist.

In terms of complex pressure amplitudes P at audience planes, it could, as a first example, be desired that the pressures have the same fixed magnitude everywhere at all frequencies. Our experience has demonstrated that uniform pressure amplitude at every position and frequency is not very useful target and it conflicts with an audiences' psychoacoustic expectations.

In a second example the target $P_{targ}(r_a,f)$ is defined as follows. $P_{targ}$ is defined only at audience positions and its value elsewhere is not taken into account in the objective function. A target shape for the pressure distribution on audience planes is set by choosing a 'mix' position $r_{mix}$ at some point away from the array on the audience planes section, and choosing sound levels, $\Delta P_{start}$ and $\Delta P_{stop}$, relative to the arbitrary pressure at $r_{mix}$ for positions at the extremes of the audience planes section. In between each extreme point and the mix position the target pressure has a constant gradient. The mix position is intended to be that at or for which the mixing engineer mixes the sounds being produced by the speaker array.

Typical values create a target that progressively drops in amplitude with increasing distance from the array. A flat frequency response at all positions is stipulated in the target $P_{targ}$ so that mixing engineers can globally adjust the spectrum to their liking.

The objective function for those two examples compares, at each point, the pressure produced by the speaker array as calculated with the target pressure and sums a measure indicative of those differences.

In a third example the objective function is, or preferably has in addition to the primary criterion of a target pressure, a measure that indicates the flatness of the frequency response at each audience position. For each point the mean pressure amplitude over frequency is determined; a flatter response is indicated by calculating a measure of how close the pressure values, at all frequencies at that position, are to the mean.

In a fourth example the objective function is, or preferably has in addition to the primary criterion of a target pressure, a second measure that quantifies the "leakage field", defined as measure indicative of the relative size (for example the ratio) of the total pressure delivered to the non-audience positions compared to the total pressure delivered to audience positions.

Measures of the partial derivatives with respect to frequency or position on our result surface could, as fifth and sixth examples, be minimised over frequency and position.

The objective function can also be a weighted combination of the examples given above for example a weighted average. The combined objective function $\epsilon(x)$ is given in Equation 1 below, where the coefficients $c_n$ controls the relative importance of the various components.

$$\varepsilon(x) = c_1 \cdot \varepsilon_{targ} + c_2 \cdot \varepsilon_{fresp} + c_3 \cdot \varepsilon_{leak} + c_4 \cdot \varepsilon_{\frac{\partial P}{\partial r}} + c_5 \cdot \varepsilon_{\frac{\partial P}{\partial f}} \quad \text{(Equation 1)}$$

where $\epsilon_{targ}$ is the measure of how closely the calculated sound field fits the target sound field, $\epsilon_{fresp}$ is the measure of flatness of the frequency response, $\epsilon_{leak}$ is the measure of leakage of the sound field to non-audience positions and $$\varepsilon_{\frac{\partial P}{\partial r}}$$

and $$\varepsilon_{\frac{\partial P}{\partial f}}$$

are the measures of the rate of change of the sound field with respect to distance and frequency respectively.

In detail, the components of the objective function are preferably calculated as follows.

$\epsilon_{targ}$ is the sum over all the audience points and over all frequencies of a measure of the difference in magnitude between $P_{targ}$ and $P_a(r_a,f,x)$ calculated in accordance with the radiation model. $P_{targ}$ may be, for example, either of the functions noted above as objective function examples one and two. Example two (in particular using the target function involving $r_{mix}$) is preferably calculated as follows.

$$mean_{rmix} = \frac{\sum_{k=1}^{k=N_f} [Pa]_{j_{mix},k}}{N_f} \quad \text{Equation 2}$$

$$\varepsilon_{targ} = \frac{\|mean_{rmix} + [Ptarg] - [Pa]\|_2}{\sqrt{N_a}} \quad \text{Equation 3}$$

Evaluation of the target $P_{targ}(r_a,f)$ at each $N_a$ audience positions by $N_f$ frequencies produces an $N_a$ by $N_f$ matrix [Ptarg], where $N_a$ is the number of audience positions and $N_f$ is the number of frequency points. $j_{mix}$ is the position index of $r_{mix}$. The $mean_{rmix}$ target component in $\epsilon_{targ}$ given in Equation 3 allows the shape of the target function to 'float' slightly in level since it is the shape that is important rather than some absolute level. Each time a new speaker array configuration is calculated a value for the mean pressure amplitude across frequency is determined at $r_{mix}$ in accordance with Equation 2; the target is then defined relative to this value. If the target was an absolute fixed value and was somewhat distant to the existing distribution then the optimiser would attempt to move the pressure closer to this—this results in significant and undesirable peaks developing since overall system gain is not a parameter available to the optimiser. This method can also be used to calculate the objective function for other target shapes $P_{targ}$ and not just the particular one mentioned above; for any such shape a mixing position $r_{mix}$ is chosen to allow the shape to float as described above.

$\epsilon_{fresp}$ is a measure that indicates the flatness of the frequency response at each audience position and is preferably calculated as follows:

$$mean_j = \frac{\sum_{k=1}^{k=N_f} [Pa]_{j,k}}{N_f} \quad \text{Equation 4}$$

$$j = 1 \ldots N_a$$

$$\varepsilon_{fresp} = \frac{\|[Pf] - [Pa]\|_2}{\sqrt{N_a}} \quad \text{Equation 5}$$

where $[Pf]$ is given by

-continued $$[Pf]_{j,k} = mean_j \quad k = 1 \ldots N_f, \quad j = 1 \ldots N_a \qquad \text{Equation 6}$$

For each audience point the mean pressure amplitude over frequency is calculated (Equation 4) resulting in a vector $mean_j$. This is expanded to a matrix of the same size as [Pa] Equation 6, which forms part of the component $\epsilon_{fresp}$ given in Equation 5. This measure of flatness of the frequency response is therefore the distance of the calculated points from the mean response at a position.

$\epsilon_{leak}$ is a measure of the relative size of the total pressure delivered to the non-audience planes to that delivered to the audience planes and is preferably calculated as follows $$\varepsilon_{leak} = \frac{\sum_{j=1}^{j=N_{na}} \sum_{k=1}^{k=N_f} [Pna]_{j,k}}{\sum_{j=1}^{j=N_a} \sum_{k=1}^{k=N_f} [Pa]_{j,k}} \qquad \text{Equation 7}$$

where Pna is the pressure matrix for the non-audience positions. The components $$\varepsilon_{\frac{\partial P}{\partial r}}$$

and $$\varepsilon_{\frac{\partial P}{\partial f}}$$

are the totals over all audience positions of the numerical partial derivatives of P(r,f,x) calculated in accordance with the radiation model with respect to distance and frequency respectively. Preferably they are calculated as follows:

$$\varepsilon_{\frac{\partial P}{\partial f}} = \frac{\left\| \frac{\partial P(r_a, f)}{\partial f} \right\|_2}{N_a} \qquad \text{Equation 8 and 9}$$

and $$\varepsilon_{\frac{\partial P}{\partial r}} = \frac{\left\| \frac{\partial P(r_a, f)}{\partial r} \right\|_2}{N_a}$$

The coefficients $c_1$ to $c_5$ of Equation 1 can be adjusted by the user to trade off between different objectives, for example sacrificing how well the pressure meets a target function against how much pressure leaks from the audience planes section and may be zero.

In the above equations the norms (indicated by the double vertical bar pairs) are calculated according to the following (with p=2):

$$\|A\|_p = \left( \sum_{i=1}^{m} \sum_{j=1}^{n} \|a_{ij}\|^p \right)^{1/p} \qquad \text{Equation 10}$$

For the optimisation iteration a starting point for the candidate parameter set is required. Generally this is not critical but a configuration in which each part of the audience is covered by the output of an element (which are directional) is likely to be in the region of the output of the optimisation and so makes a reasonable starting point since the optimisation process will take less time on the computer. Preferably at least the top box should be orientated towards the most distant audience position. The user can choose this or select a starting point of their own.

Figure 4:
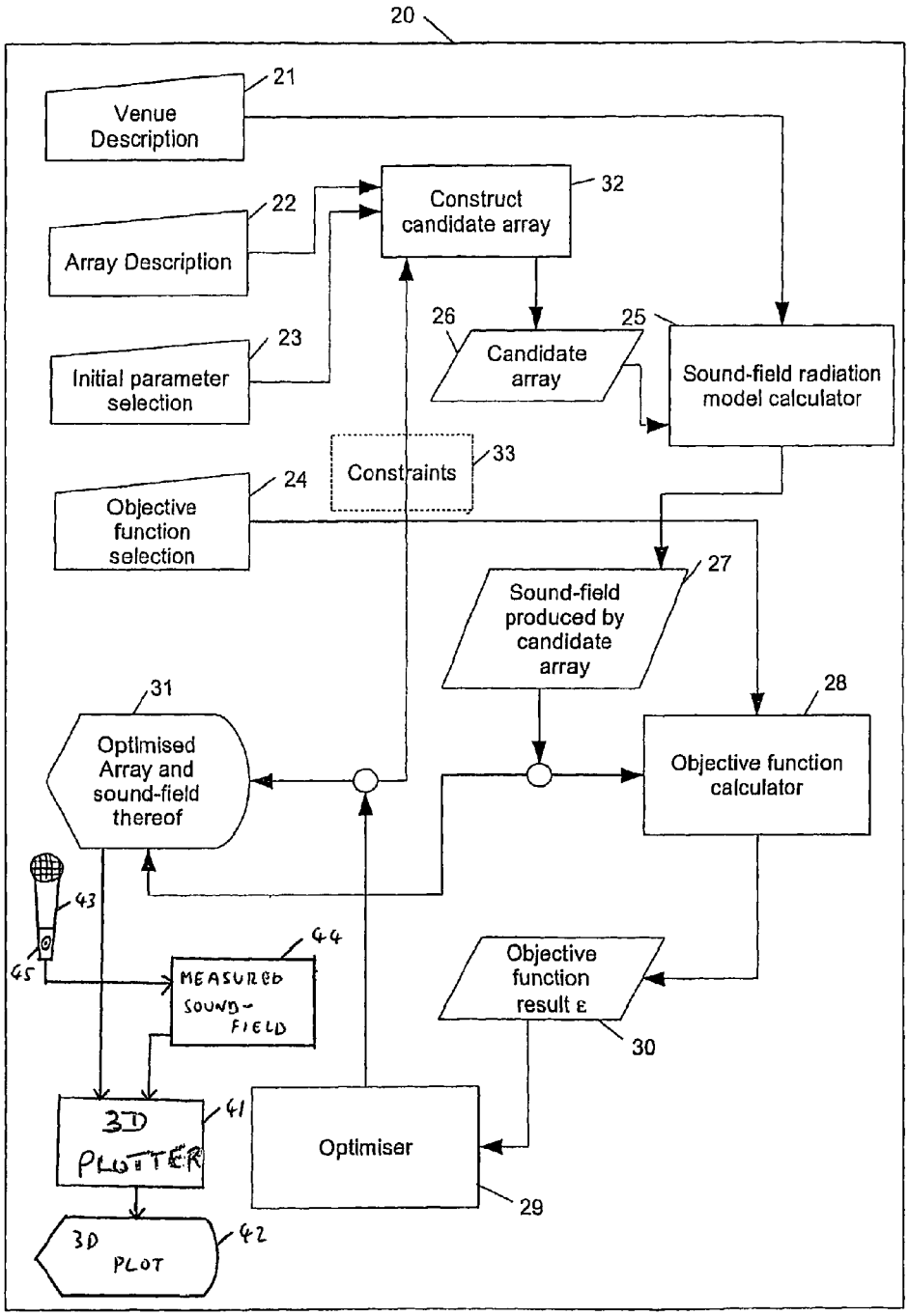
FIG. 4 is a system block diagram of the computer system of the present invention.
Figure 5A:
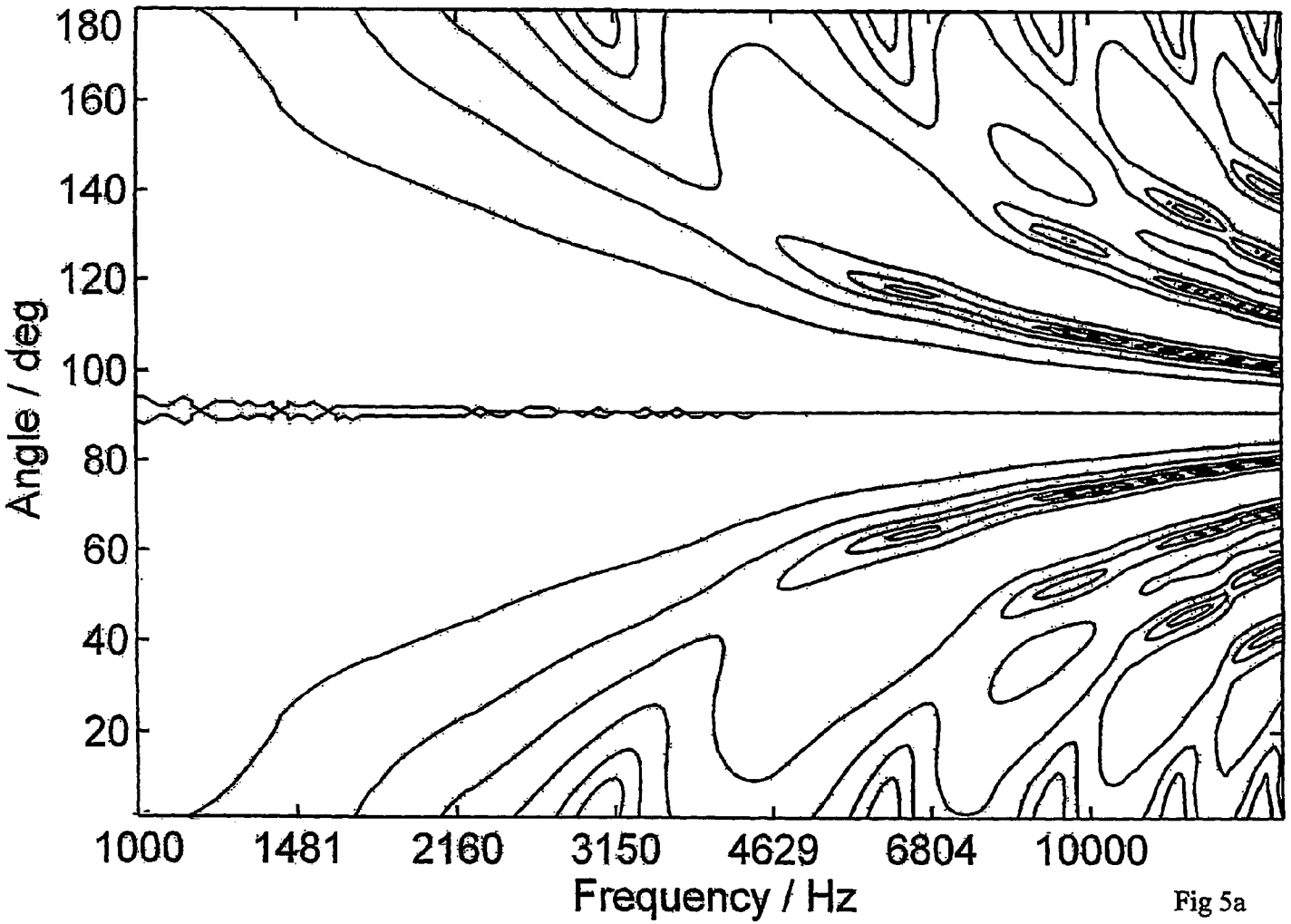
FIGS. 5A TO 5D each show hemispherical polar performance of one element of the line arrays simulated in the examples.
Figure 5B:
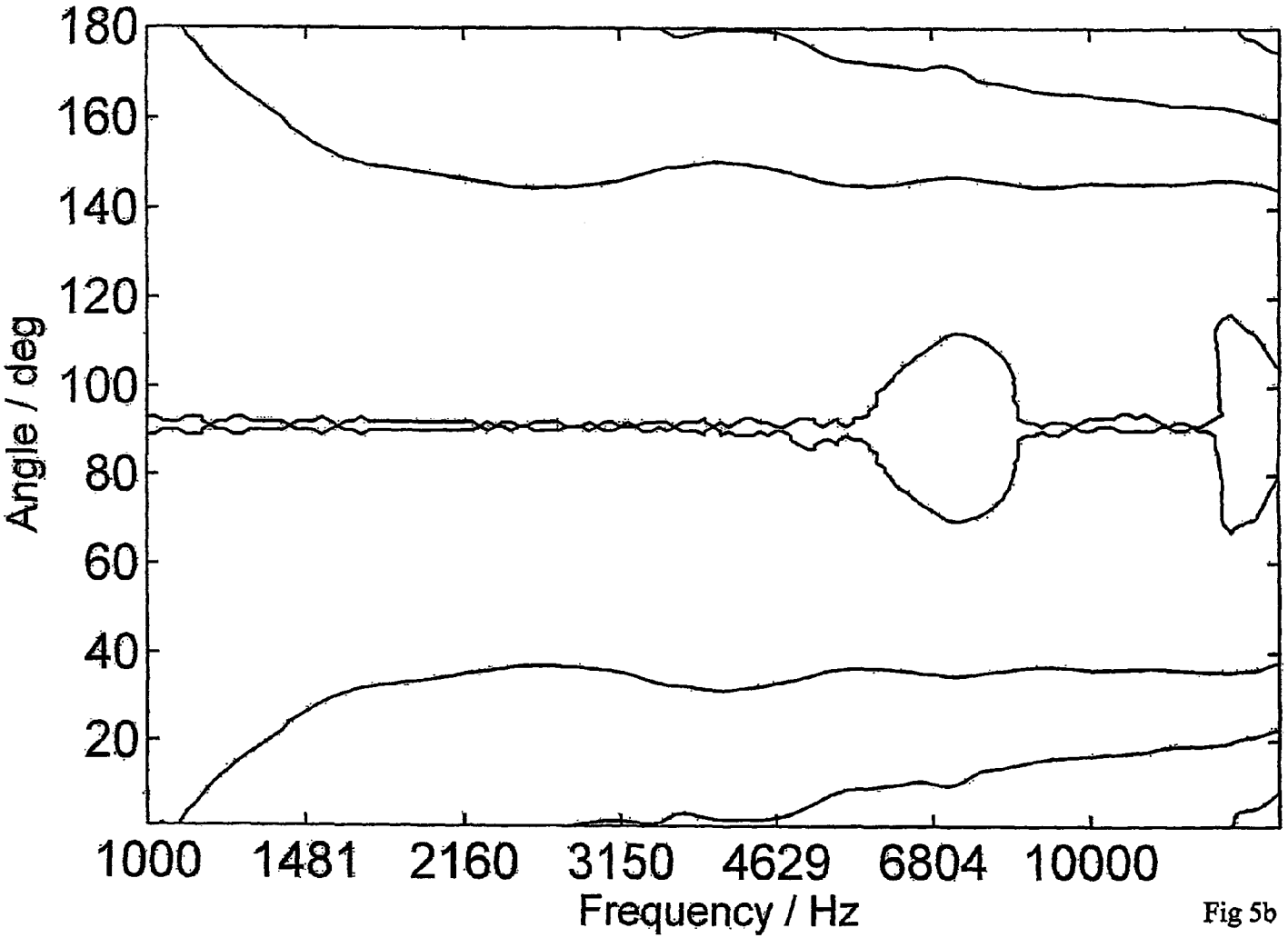
Figure 5C:
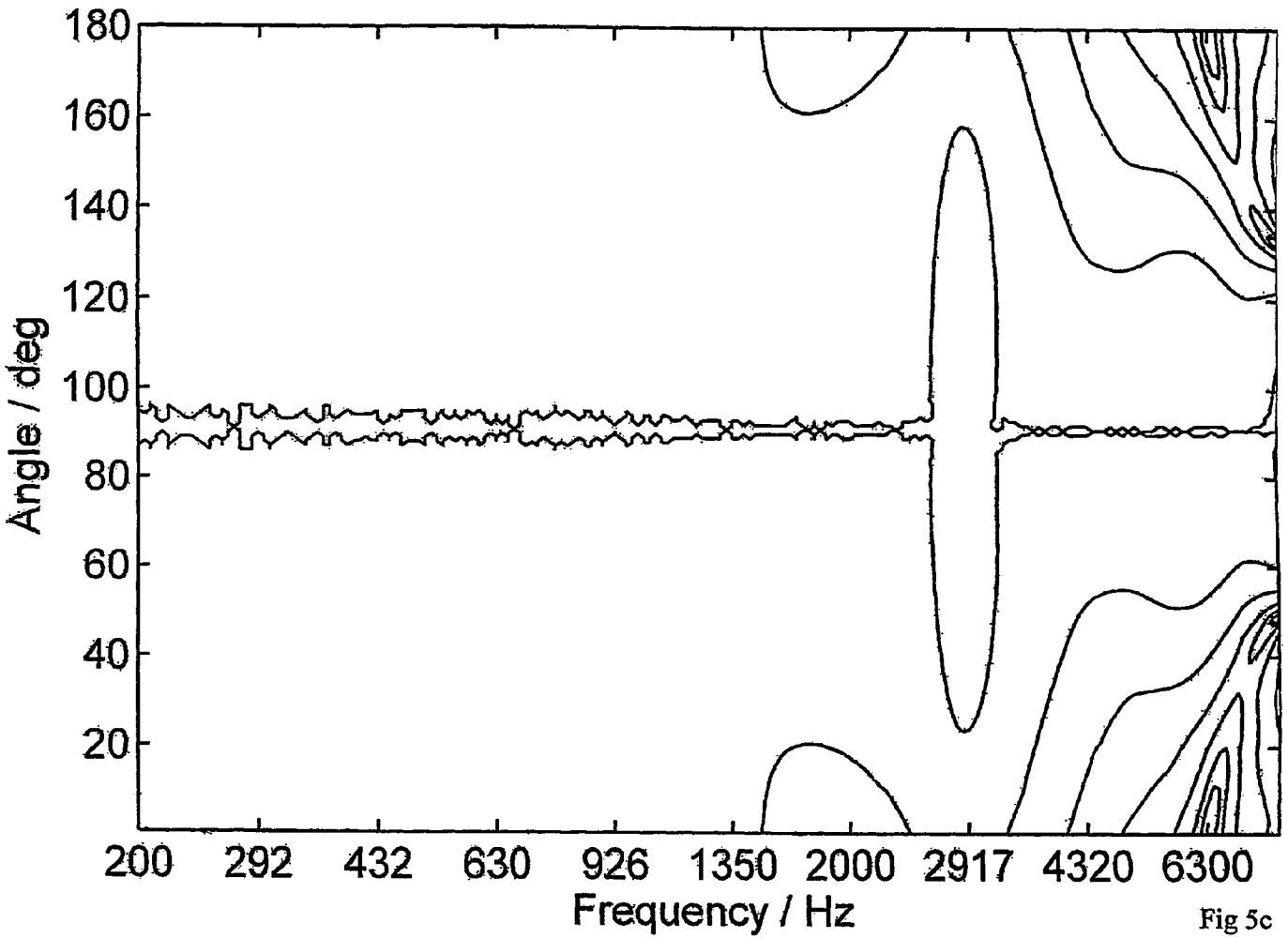
Figure 5D:
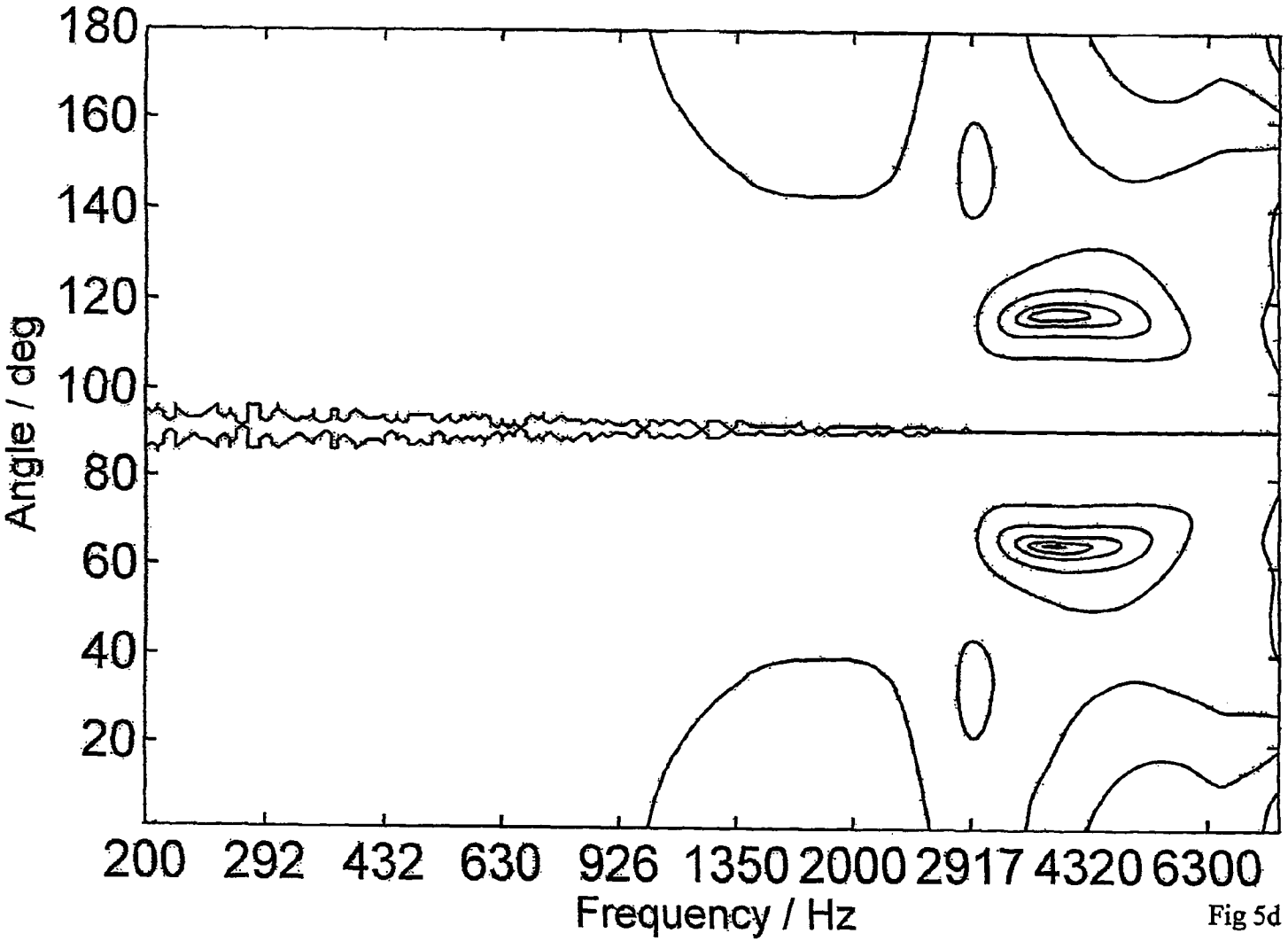

FIG. 4 is a system diagram showing the components of the software system used to perform the optimisation. The software is run on a standard personal computer 20. It comprises input modules 21, 22, 23, 24 that allow the user to input respectively a description of the venue (i.e. the information in FIG. 1 concerning the audience positions and the non-audience positions), a definition 22 of the array (including the positions of the element speakers, and their acoustic properties for use in the radiation model), a selection 23 of the parameters (e.g. splay angles) to be used as the first candidate, and a selection 24 of the objective function to be used in the optimisation (e.g. a selection of weights $c_1$ to $c_5$). The optimisation loop proceeds as follows. A sound radiation field calculator 25 takes as its input the venue description 21 and a candidate array description 26 (which includes the properties 22 of the array elements and the selected parameters 23 for the candidate array) and produces from that the simulated sound field 27 that would be produced by the array. An objective function calculator 28 uses the sound field and the selected 24 objective function to evaluate the objective function. An optimiser 29 uses the result 30 of that to see if the candidate array is better than the previous one and to construct 32 a new candidate 26, unless the optimiser decides that the optimised parameter set has now been found. The optimiser may use any of many available optimisation methods available, including Method 1 that was described above. Once the optimised parameter set 31 has been found it is provided to an output module, which displays it to the user together with the sound field 31 calculated for the speaker array as defined by the parameter set, the latter both for interest and user confirmation that a sensible result has been found.

Once the optimised parameters have been found (e.g. splay angles for a line array) have been determined by the optimisation calculation the user adjusts the physical array 1 in accordance with those parameters).

In a second example of the invention the speaker array is optimised using a constraint on the parameters, in this instance the splay angles. In this example the generalised pattern search (i.e. Method 1 above) is again applied to the splay angles parameters for a uniformly driven array in an example venue, again as shown in FIG. 1. The objective function is taken as equation 1 above with $c_1$=1 and $c_i$=0 for i=2 to 5 and $P_{targ}(r_a,f)$ being based on the mixing position as described above with values for $\Delta P_{start}$ and $\Delta P_{stop}$ of +6dB and −6dB respectively. An example array on which this example of the invention was performed comprises of 20 identical elements 115 mm high each containing an HF and LF section in close proximity; polar performance for a single element is shown in FIGS. 5*a* to 5*d* in which each contour is a 3dB change. The maximum splay between elements is 6 deg and the minimum is 0 deg with 0.5 deg steps available in this range.

The constraint used in this example is a progressive curvature of the array. This is achieved by splitting the array into 7 sections, one for each major division of the splay angle range. All the elements of a section have the same splay angle, starting at 0 and ending at 6 in the last section. The array is defined by the number of elements in each section, which are then the parameters optimised. The computer system used is the same as in FIG. 4 but the optimiser uses as the parameters to be adjusted the set of the number of elements in each section, rather than the splay angles directly. Once the optimiser has selected a new candidate the parameter set is turned into a set of splay angles for each of the elements and the simulated sound field is calculated as before. Note it is allowed to have zero elements in a section.

Figure 6A:
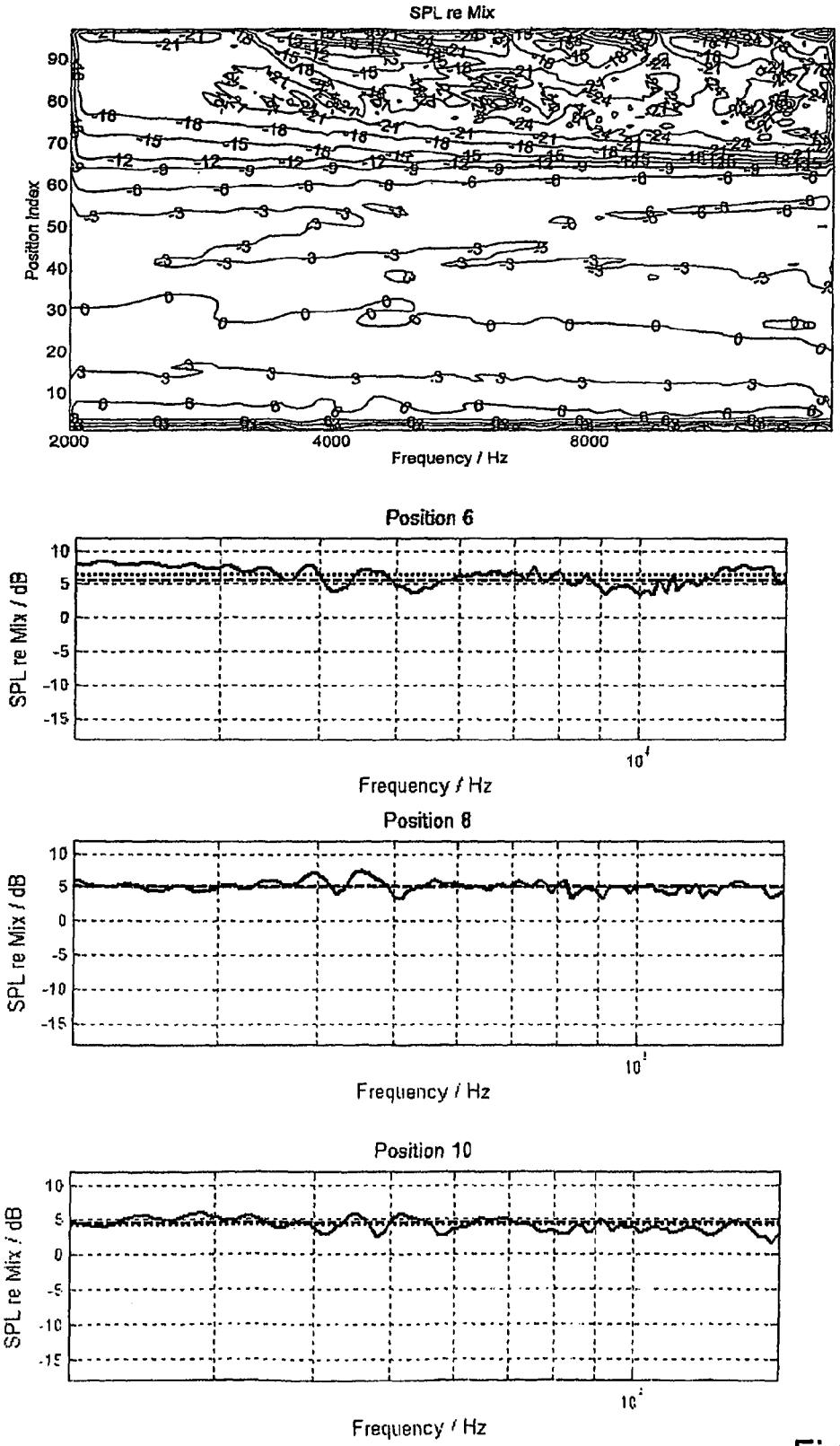
FIGS. 6A AND 6B each show performance of a line array optimized using the optimisation in a second example.
Figure 6B:
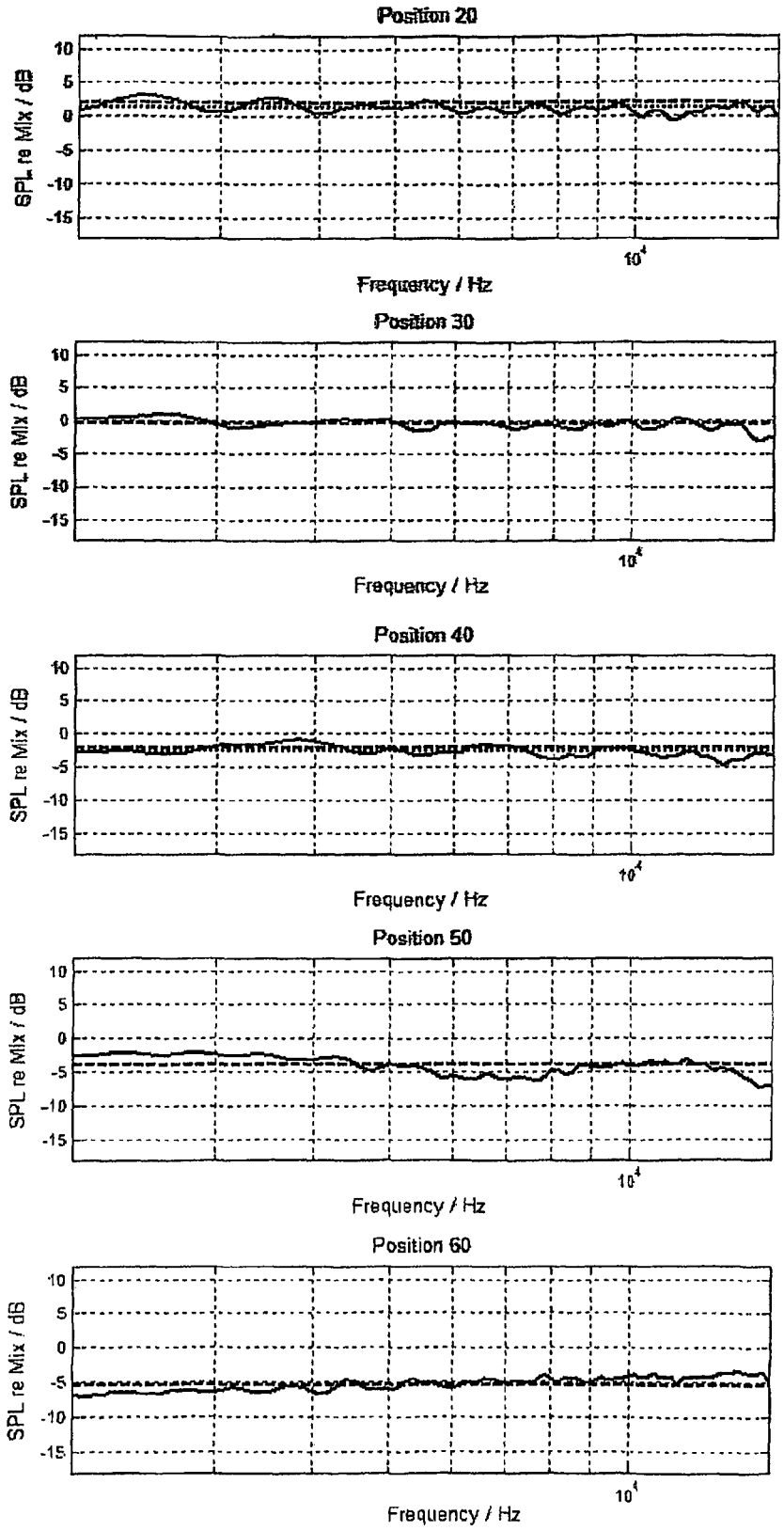

Displayed in FIGS. 6*a* and 6*b* is the sound field generated in this constrained example. This shows a 3D contour plot of the sound pressure level against position and frequency and below that several graphs of the sound pressure against frequency at selected ones of the audience positions. On those graphs the long dashed level is the target level and the dotted level is the average level achieved, which ideally should be the same.

The pattern search algorithm took just under 70s to perform the 7 iterations in which 81 function evaluations were performed. The routine was halted when a minimum mesh size had been reached; other runs allowing smaller meshes did not result in significantly better solutions.

Figure 7A:
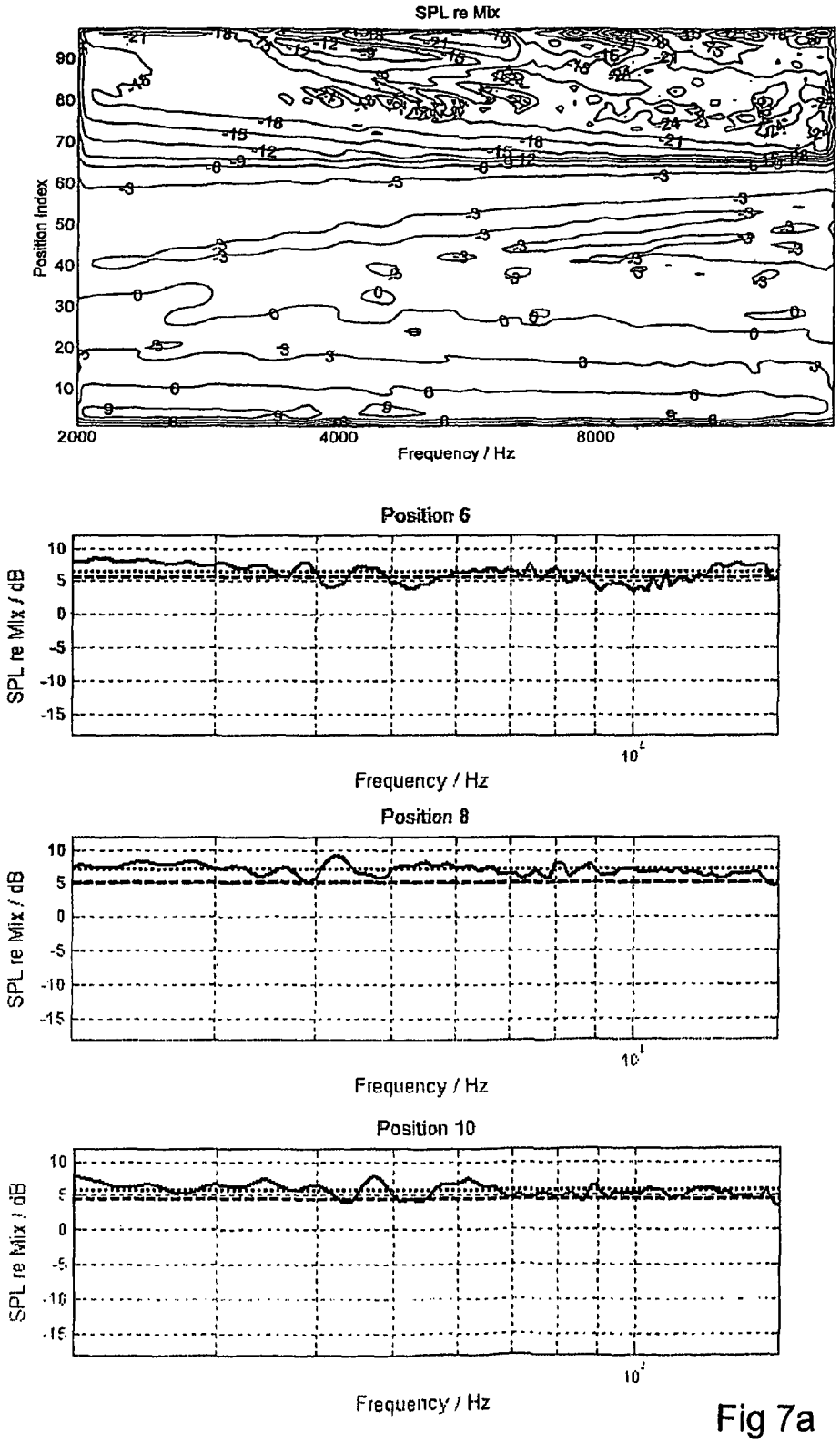
FIGS. 7A AND 7B each show performance of a line array adjusted manually, FIGS. 8A AND 8B each show performance of a line array optimized using the optimisation in a first example.
Figure 7B:
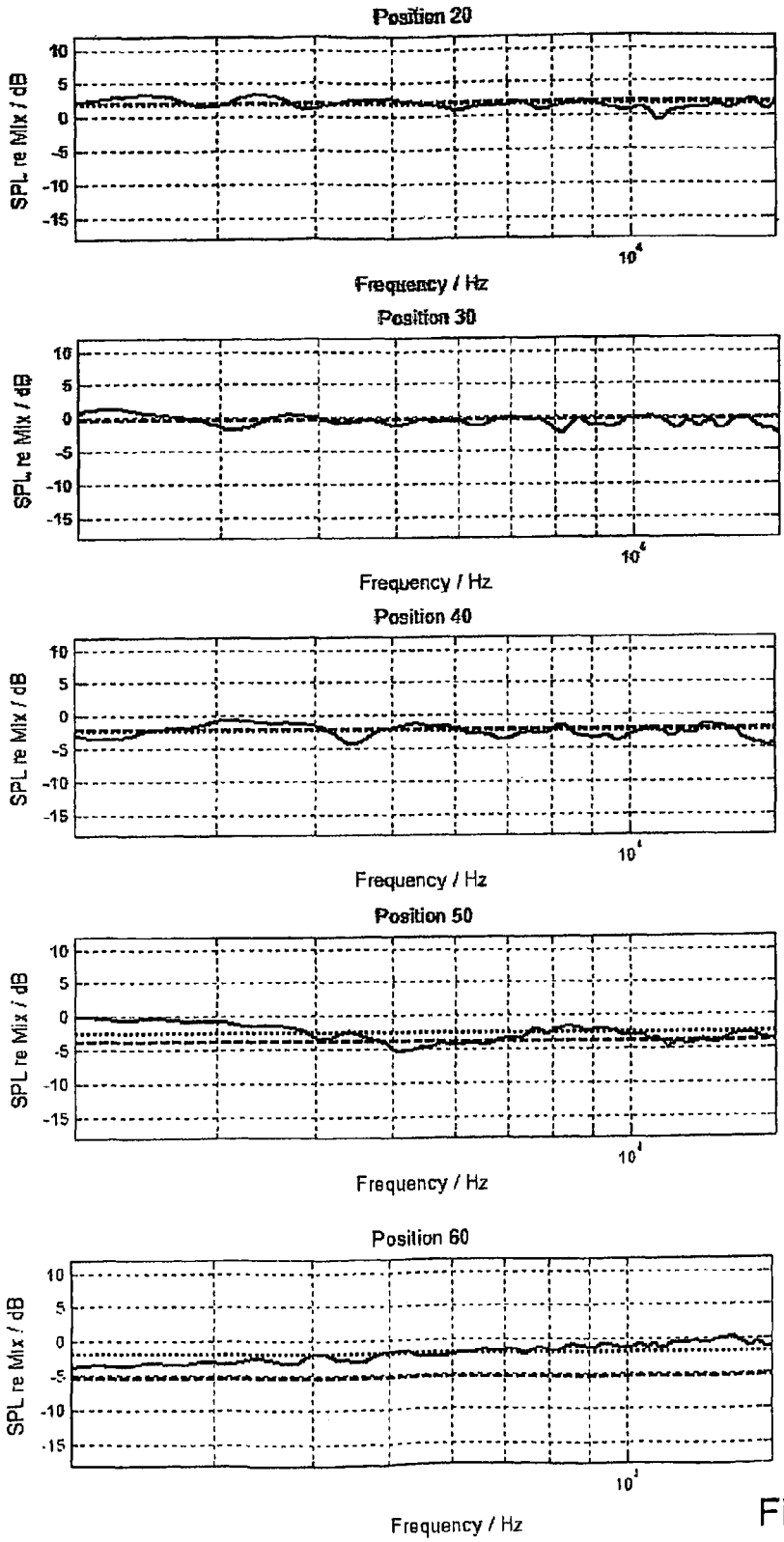
Figure 8A:
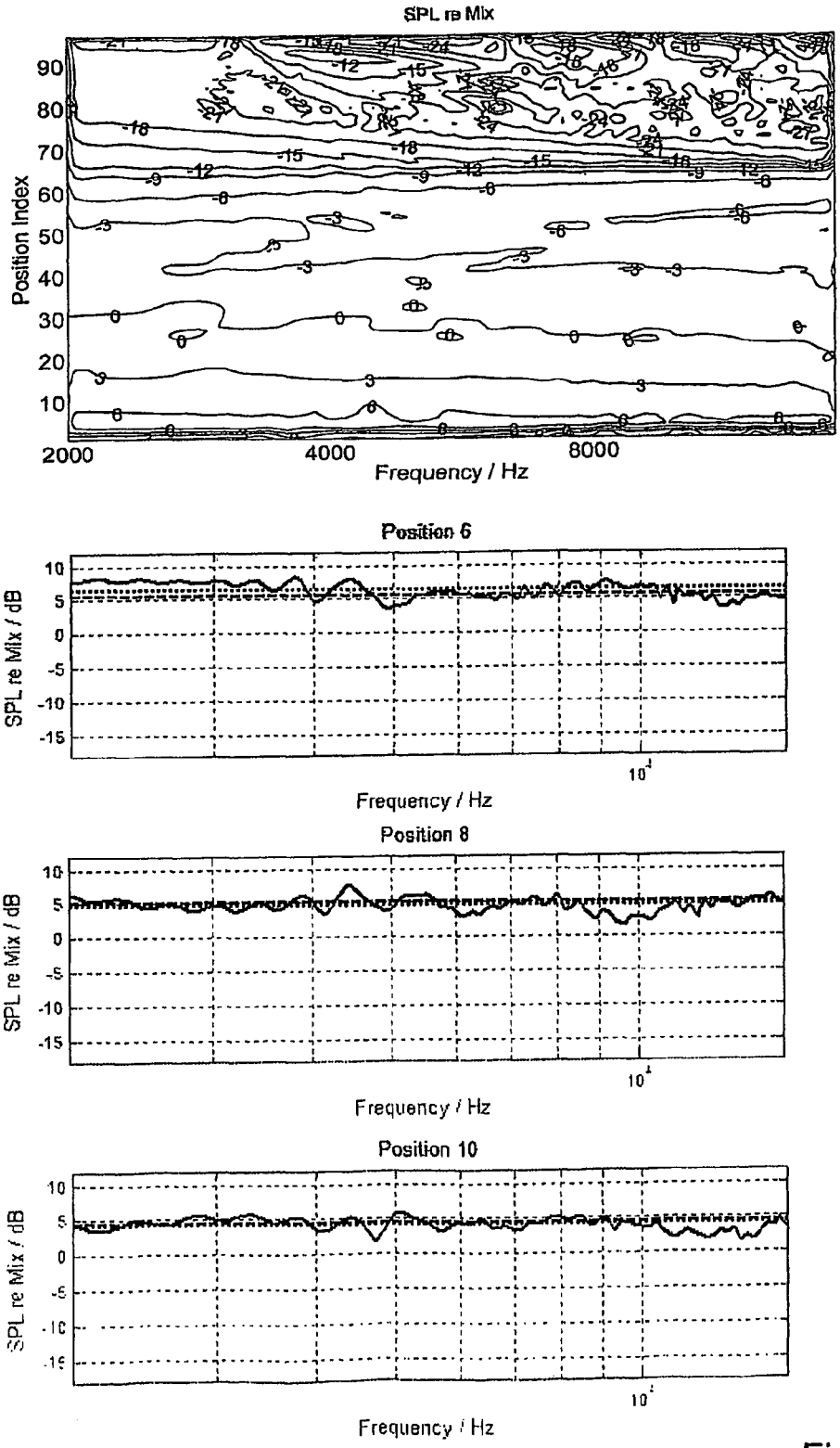
Figure 8B:
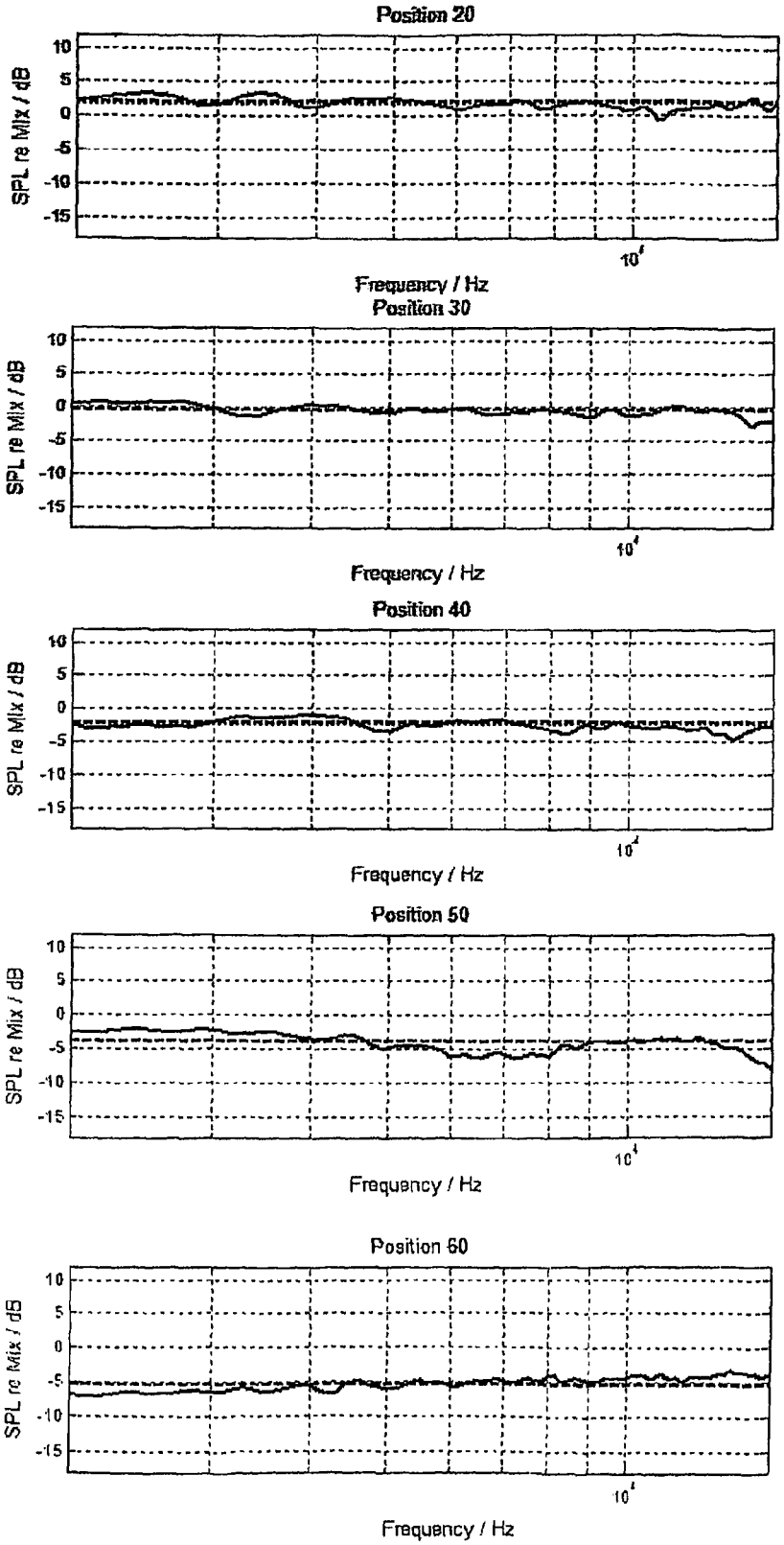

For comparison a set of splay angles was determined manually (i.e. using a prior art CAD system that calculates just the sound field for a user chosen set of splay angle) in an effort to achieve a particular target and the results are shown in FIGS. 7*a* and 7*b* is (in a similar manner to FIG. 6*a* and 6*b*. FIGS. 8*a* and 8*b* show the results for the unconstrained computer optimisation of the first example above. The manual attempt was fairly lacklustre at fulfilling the target; it very nearly has the same number of elements in each section. The constrained computer optimisation appears better in that it meets the desired pressure distribution shape as dictated by $P_{targ}$. (The starting point splay angles for constrained computer optimisation and the manual procedure were the same.)

Figure 9A:
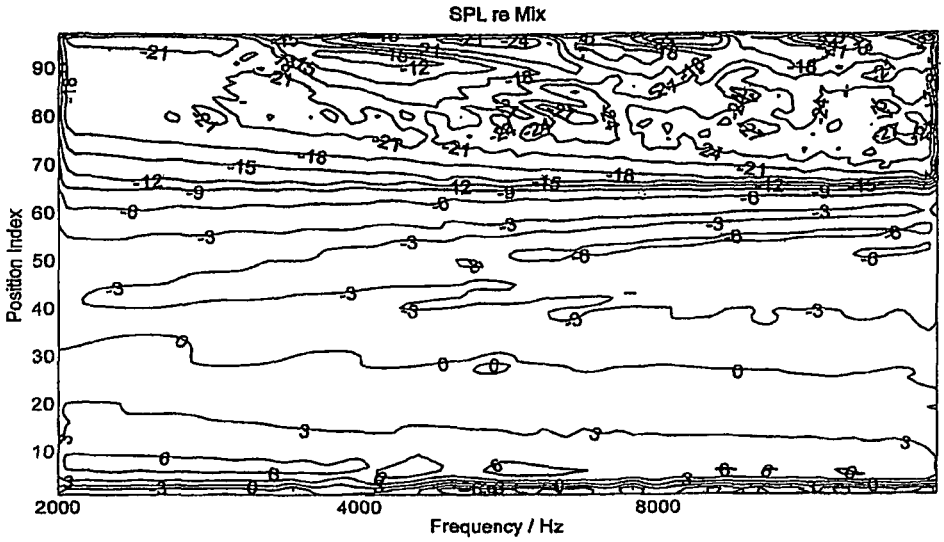
FIGS. 9A TO 9C each show performance of a line array optimised using the optimisation in a third example using an objective function comprising a leakage component.
Figure 9B:
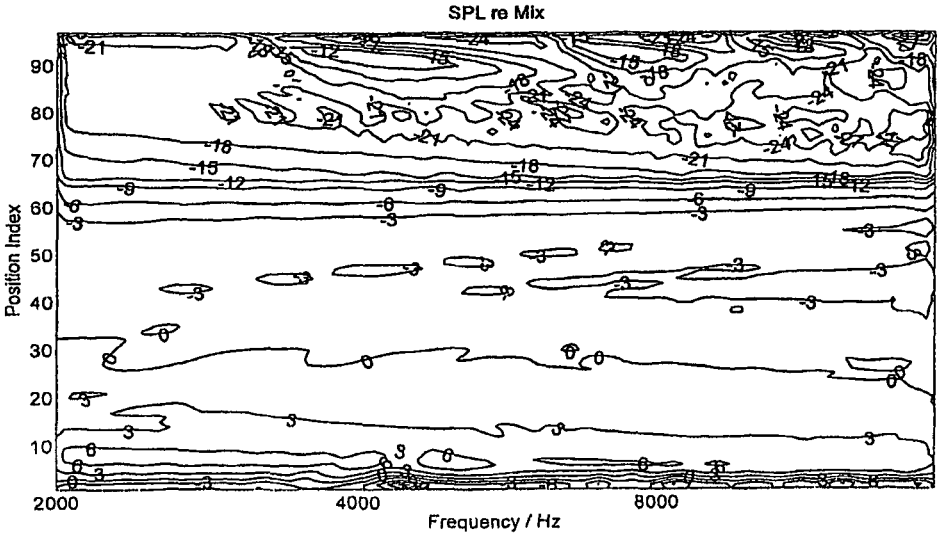
Figure 9C:
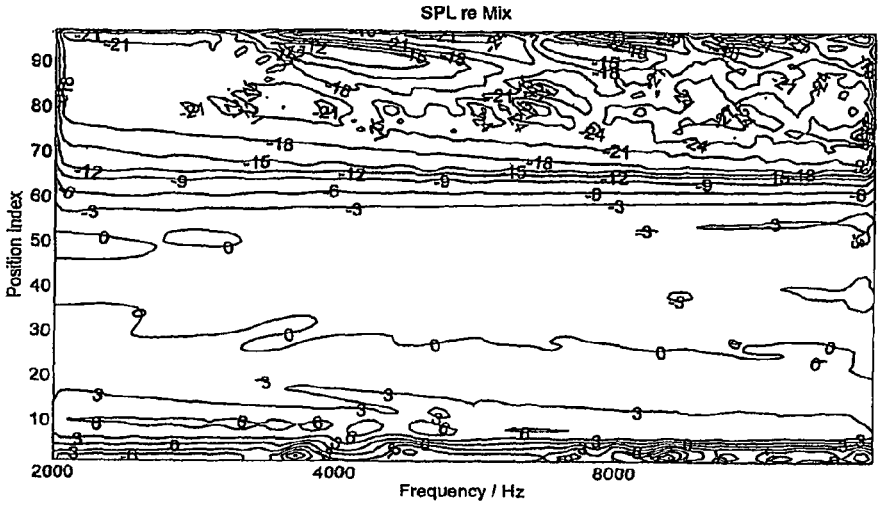

As a third example of the invention, the effect of including $\epsilon_{leak}$ as well as $\epsilon_{targ}$ are shown in FIGS. 9*a* to 9*c*, which has three 3D plots with increasing values of $c_3$ for the leakage component. As more account is taken of the leakage the sound concentrates at the central audience positions.

Similar results were obtained for the first unconstrained example above. FIGS. 8*a* and 8*b* show array performance for that example. The routine used a mesh size and time limit stopping criteria. After 20 mins and over 800 function evaluations the routine was stopped. Other runs allowing more time produced little further improvement before being stopped by the mesh size criteria.

Figure 10A:
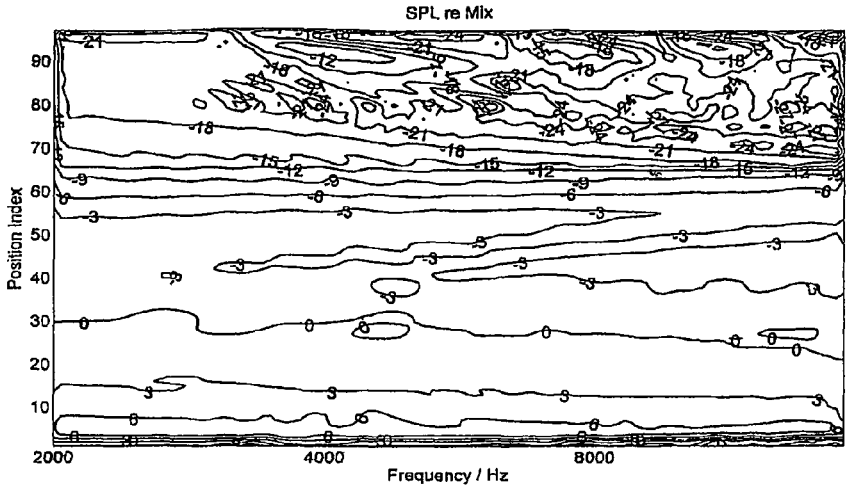
FIGS. 10A AND 10B each show performance of a line array optimized using the optimisation in a third example using an objective function comprising a flatness component.
Figure 10A:
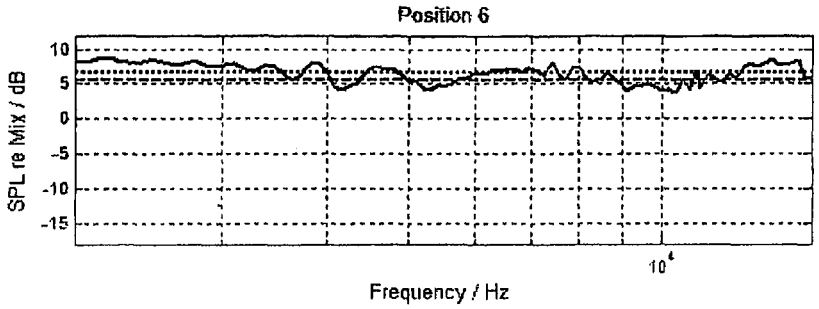
Figure 10A:
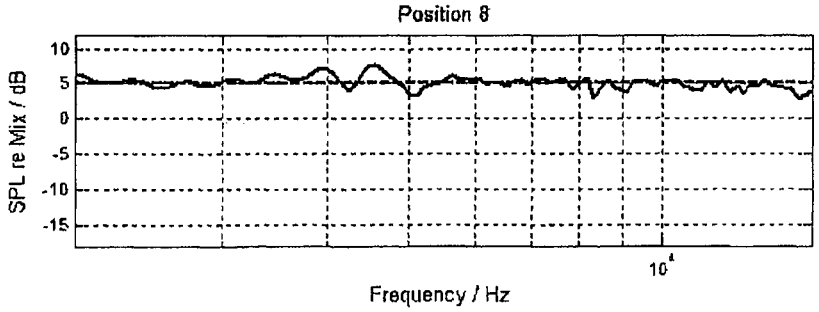
Figure 10A:
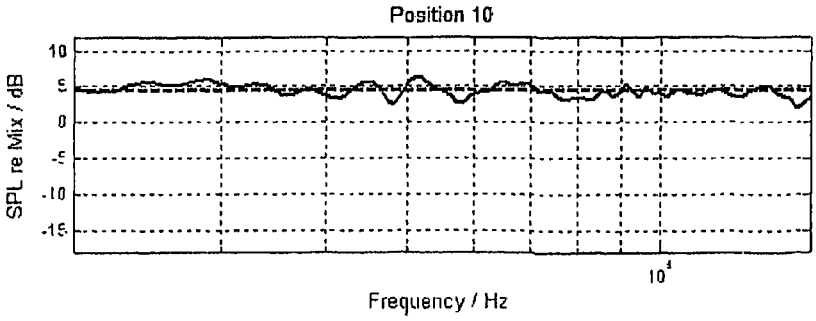
Figure 10B:
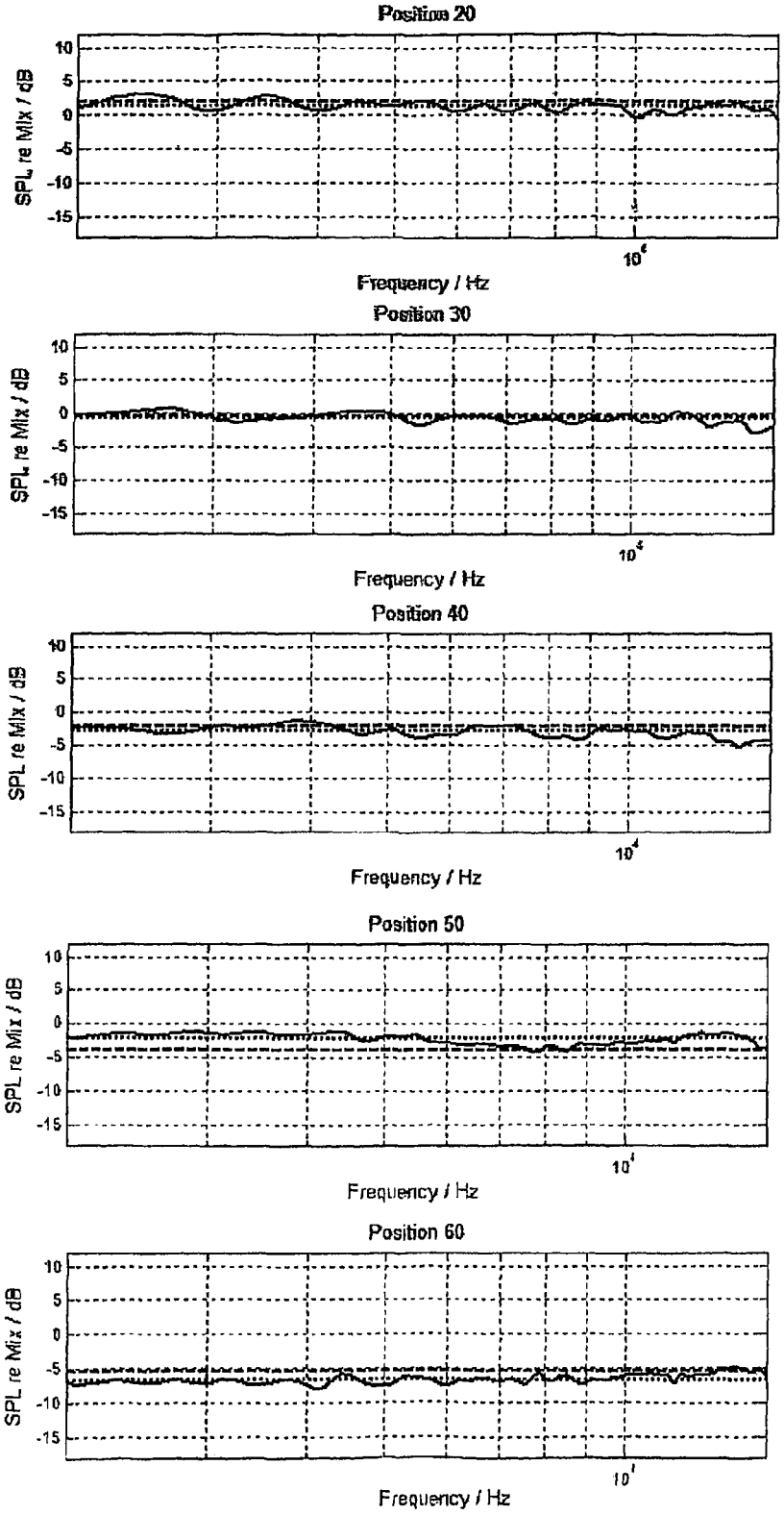

For a fourth example, FIGS. 10*a* and 10*b* show the effect of including $\epsilon_{fresp}$ in addition to $\epsilon_{targ}$. The frequency responses for this example are noticeably flatter than for the other examples and at a little expense of being less close to the target.

Note that in the examples above changing the splay angles of the line array elements affects their position, since the more curved the array becomes the further back the lower elements move with respect to the audience positions. The optimisation takes this into account by calculating the new positions of the elements each time the splay angles are changed. These new positions are taken into account by the sound field calculation for the new array configuration.

Figure 11:
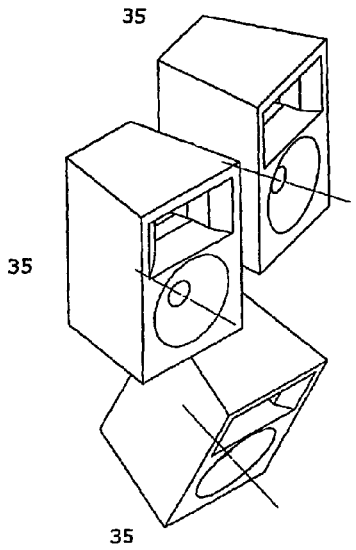
FIG. 11 shows a speaker element cluster array optimised using the present invention.

In a fifth example of the invention the optimisation is applied to further parameters of the array of speakers 35, in particular to the position of the elements. FIG. 11 shows another speaker array in which both the orientation and the position of the individual elements can be adjusted by the user. Here three speakers are mounted in a cluster on traditional "yokes" or "flying frames" (not shown) which allow their orientations to be adjusted. The computer optimisation method of the invention is used to optimise their orientations. Here the individual speakers are not all pointing to audience positions in the same vertical plane and so they deliver significant sound levels . (Compare the line array examples above.) To cope with that the optimisation uses audience and non audience positions in vertical planes, one for each of the speakers in the cluster, that contain the axis of their respective speaker in its initial pre optimisation position. The orientations of each speaker both in the horizontal and vertical directions are made parameters of the optimisation. The sound pressure at each audience and non-audience position is calculated from the contributions made by all of the speakers. The objective function, for example, one of those from the examples above, is then calculated across all the points (audience or non-audience as appropriate) on all of the vertical planes. This may be a more lengthy calculation than for a single vertical plane but is more efficient than covering the whole of the venue space with calculation points.

Figure 12:
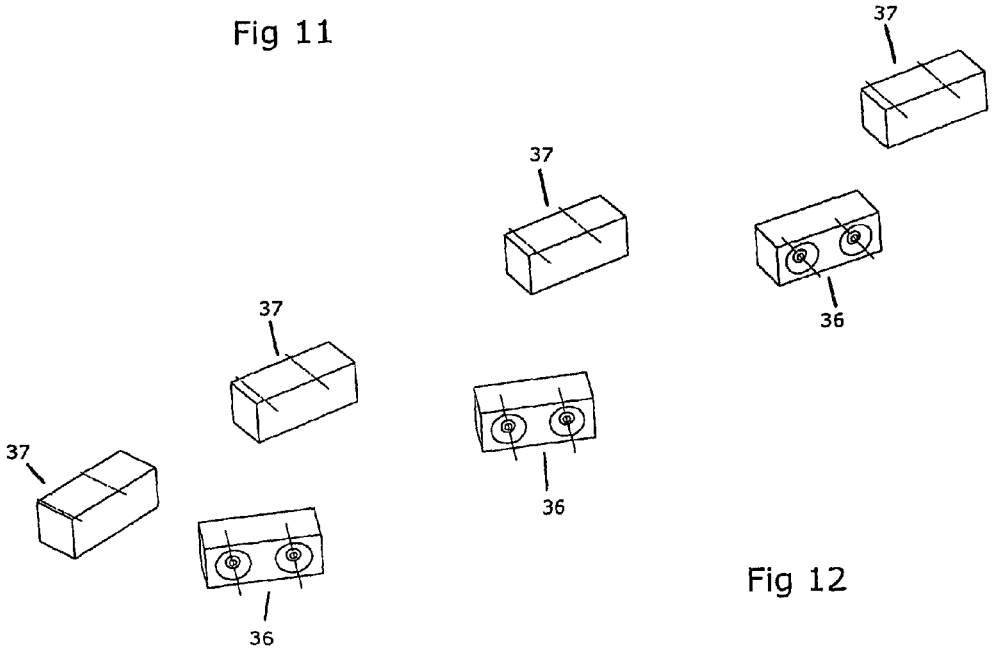
FIG. 12 shows an array of floor positioned speakers optimised using the present invention.

In a sixth example of the invention the speaker array is as shown in FIG. 12. In this a plurality of low frequency speakers 36 and 37 are placed on the floor or stage of the venue. The speaker units can be easily moved in position or orientation about the vertical axis by moving about the floor or stage. Those variables are parameters of the optimisation in this example. Other parameters used in this example are the phase (i.e. polarity) of the signal applied to the unit (which is usually achieved in the controller that supplies the signals to speaker units), and the gain and delay applied to the signal applied to each speaker unit. Although orientation is one of the parameters of the optimisation, because low frequency units are not very directional the orientation has only a small effect on the sound field; the parameter of position has a greater effect. Delay and phase have similar effects to position and are included because there can be constraints on the positioning of the speakers, for example the speaker units may be limited to certain areas on the venue floor or stage. As with the other examples above the system allows constraints on these parameters to be applied during the optimisation process. The optimisation for this array uses preferably audience and non-audience points on a centre line though the venue from the array to the furthest audience points. It nonetheless allows the user to specify additional planes but this increases the computation time. However since at low frequencies the gird on which the sound field is simulated can be 2-3 m in pitch it is feasible to calculate the sound field for all audience positions in a venue (i.e. not just limited to those on selected plane(s)).

FIG. 12 shows some 37 of the units being rearward facing. These act to cancel parts of the sound field produced by the array. Nonetheless these units are treated in the same way as the others in the optimisation and can arise from it (as long as no constraint on the orientation of the units prevents this.)

All the examples above have had orientation of the speaker elements as one of the adjustable parameters. It would nonetheless be possible for the invention to use just, for example, the positions of the speakers, if for example the orientation could not be adjusted. Or given that low frequency speakers are not very directional in the sixth example above orientation could be omitted without the result being degraded too much for some applications.

In the cases above where the sound field calculation involves speaker elements not on one of the vertical planes containing the audience points the sound field calculation simply takes into the actual distance between the element and the point of interest; in such cases, however, the balloon of points surrounding the element used in the sound model becomes 3-dimensional rather than 2-dimensional. Indeed the points of interest taken into account in the objective function need not be confined to the vertical planes of the examples; interesting points from all over the 3-dimensional volume (for example all audience points) could be taken into account. The number of points used, should preferably not be so great as to make the optimisation calculation take so long as to be inconvenient to the user.

As noted above, the 3D plot is a useful item. The computer 20 is preferably provided with a 3D plotter 41 to produce the 3D plot 42. This displays the 3D plot either on the monitor of the computer or sends it to a printer to be printed. The 3D plotter 41 plots the sound pressure level on one axis, against position and frequency on the other two axes. As shown in the Figures attached hereto, the 3D plot may be rendered in two dimensions having axes of positions and frequency, with the sound pressure level being indicated by contours and/or level shading or colours.

The 3D plotter 41 may also be provided as a stand-alone device, independent of the speaker array optimiser provided by personal computer 20. As an independent device, the plotter is connected to a sound pressure measuring device 43, for example a microphone, to receive measurements of the sound field. Alternatively a plurality of microphones at different positions may be used.

If a single microphone is used then this is moved from position to position to receive test sounds. These, of course, may be generated by a speaker array as previously herein described but, of course, other sources may well be of interest.

The positions for each measurement can either be keyed in by hand or can be recorded by an automatic, position measuring device 45.

(For the avoidance of doubt, if the 3D plotter 41 is comprised in the personal computer 20, then the latter of course is still a sound pressure plot device in accordance with the invention.)

The invention claimed is:

1. A method of configuring an array of speaker elements for use in a venue, comprising:

providing an initial candidate configuration for the array of the speaker elements as a candidate configuration of the array of the speaker elements and iterating in a plurality of iterations having steps of:

computing, with a computer and using a radiation model, a sound field produced by the array of the speaker elements having the candidate configuration, at a plurality of points in the venue;

evaluating, for the candidate configuration of the array of the speaker elements, with the computer, an objective function involving the computed sound field at a plurality of audience positions in the venue; and selecting a new candidate configuration for the array of the speaker elements as the candidate configuration of the array of the speaker elements;

repeating the steps of the iterations, thereby iterating a plurality of candidate configurations, until stopping in accordance with a stopping criteria; and configuring the array of the speaker elements in accordance with a selected one of the plurality the of candidate configurations of the array of the speaker elements for which the objective function was evaluated by the plurality of the iterations, wherein the objective function comprises:

a sum, over the plurality of the audience positions in the venue, of a measure indicative of a difference between a magnitude of the sound field and a target value for the magnitude of the sound field at the plurality of the audience positions in the venue; and a measure indicative of a relative size of total sound pressure delivered to non-audience positions compared to the total sound pressure delivered to the plurality of the audience positions in the venue.

2. The method as claimed in claim 1, wherein the target value at each audience position is taken to be relative to a mean value, at each iteration, of the magnitude of the sound field over a set of frequencies at that audience position.

3. The method as claimed in claim 1, wherein the target value is defined at a first audience position and target values for other positions are interpolated from the target value to respective target values at the other positions at a distance from the first audience position.

4. The method as claimed in claim 1 wherein the objective function further comprises a sum, over the plurality of the audience positions in the venue, of a measure indicative of a rate of change of the magnitude of the sound field with respect to frequency.

5. The method as claimed in claim 1 wherein the objective function further comprises a sum, over the plurality of the audience positions in the venue, of a measure indicative of a rate of change of the sound field with respect to position.

6. The method as claimed in claim 1 wherein the objective function further comprises a measure of flatness of a frequency response over the plurality of the audience positions in the venue.

7. The method as claimed in claim 6 wherein the measure of the flatness is a measure of how the magnitude of the sound field is, for a set of frequencies, close to a mean value for the magnitude of the sound field at each audience position.

8. The method as claimed in claim 1 wherein computing the sound field comprises computing the magnitude of the sound field in terms of a sound pressure level.

9. The method as claimed in claim 1 wherein selecting the new candidate configuration for the array of the speaker elements is subject to a constraint.

10. The method as claimed in claim 1 wherein the plurality of the candidate configurations are parameterised in terms of orientation of the speaker elements of the array.

11. The method as claimed in claim 1 wherein the plurality of the candidate configurations are parameterised in terms of the plurality of the audience positions in the venue.

12. The method as claimed in claim 1 wherein the plurality of the candidate configurations are parameterised in terms of polarity of connection of a sound signal applied to the speaker elements of the array.

13. The method as claimed in claim 1 wherein the plurality of the candidate configurations are parameterised in terms of a gain applied to a sound signal applied to the speaker elements of the array.

14. The method as claimed in claim 1 wherein the plurality of the candidate configurations are parameterised in terms of a delay applied to a sound signal applied to the speaker elements of the array.

15. The method as claimed in claim 1 wherein the array of the speaker elements is a line array comprising a plurality of linked speaker elements, angles between the linked speaker elements being adjustable.

16. The method as claimed in claim 15 wherein the plurality of the candidate configurations determine the angles between the linked speaker elements and values for the angles are constrained so that in one direction along the array of the speaker elements the angle between each speaker element and an immediate next speaker element is matching or larger than the angle between that speaker element and a previous speaker element.

17. The method as claimed in claim 15 wherein the new candidate configuration determines the angles between the speaker elements and values for the angles are constrained to adopt, independently each other, other values between two limit values.

18. A method of configuring a line array of speaker elements for use in a venue, the speaker elements being linked and angles between the speaker elements being adjustable, the method comprising:

providing an initial candidate configuration as a candidate configuration for the line array, wherein configuration of a candidate array is parameterised in terms of orientation of the speaker elements of the line array, and iterating, in a plurality of iterations having steps of:

computing, with a computer and using a radiation model, a sound field produced by the candidate array having the candidate configuration, at a plurality of points in the venue;

evaluating, for the candidate configuration, with a computer, an objective function that comprises a sum, over a plurality of audience positions, of a measure indicative of a difference between a magnitude of the computed sound field and a target value for a magnitude of the sound field at the plurality of the audience positions, and a measure indicative of a relative size of total sound pressure delivered to non-audience positions compared to total sound pressure delivered to the plurality of the audience positions; and selecting a new candidate configuration as the candidate configuration for the line array by changing parameters;

repeating the steps of the iterations, thereby iterating a plurality of candidate configurations, until stopping in accordance with a stopping criteria; and configuring the line array in accordance with a selected one of the plurality of the candidate configurations produced by the plurality of the iterations by adjusting the angles of the speaker elements of the line array accordingly.

19. The method as claimed in claim 18, wherein the target value at each audience position is taken to be relative to a mean value, at each iteration, of the magnitude of the sound field over a set of frequencies at that audience position.

20. The method as claimed in claim 18, wherein the target value is defined at a first audience position and target values for other positions are interpolated from the target value to respective target values at the other positions at a distance from the first audience position.

21. The method as claimed in claim 18, wherein each candidate configuration is parameterised in terms of orientation of the speaker elements of the line array.

22. The method as claimed in claim 18, wherein each candidate configuration is parameterised in terms of polarity of connection of a sound signal applied to the speaker elements of the line array.

23. The method as claimed in claim 18, wherein each candidate configuration is parameterised in terms of a gain applied to a sound signal applied to the speaker elements of the line array.

24. The method as claimed in claim 18, wherein each candidate configuration is parameterised in terms of a delay applied to a sound signal applied to the speaker elements of the line array.

25. The method as claimed in claim 18, wherein the objective function further comprises a sum, over the plurality of the audience positions, of a measure indicative of a rate of change of the magnitude of the sound field with respect to a frequency.

26. The method as claimed in claim 18, wherein the objective function further comprises a sum, over the plurality of the audience positions, of a measure indicative of a rate of change of the sound field with respect to a position.

27. The method as claimed in claim 18, wherein the objective function further comprises a measure of flatness of a frequency response over the plurality of the audience positions.

28. The method as claimed in claim 27, wherein the measure of the flatness is a measure of how the magnitude of the computed sound field is, for a set of frequencies, close to a mean value for the magnitude of the computed sound field at each audience position.

29. A non-transitory computer readable memory medium storing executable program instructions and data that when run by a computer causes the computer to execute a process comprising:

receiving an initial candidate configuration as a candidate configuration for an array of speaker elements;

iterating having steps of:

computing, using a radiation model, a sound field produced by the array of the speaker elements having the candidate configuration at a plurality of points in a venue;

evaluating, for the candidate configuration, an objective function involving the computed sound field at a plurality of audience positions in the venue; and selecting a new candidate configuration as the candidate configuration for the array of the speaker elements;

repeating the iterating steps thereby iterating a plurality of candidate configurations, until stopping in accordance with a stopping criteria; and selecting one of the plurality of the candidate configurations of the array of the speaker elements for which the objective function was evaluated by the iterating steps, wherein the objective function comprises:

a sum, over the plurality of the audience positions in the venue, of a measure indicative of a difference between magnitude of the sound field and a target value for the magnitude of the sound field at the plurality of the audience positions; and a measure indicative of a relative size of total sound pressure delivered to non-audience positions compared to total sound pressure delivered to the plurality of the audience positions in the venue.

* * * * *